US011732712B2

(12) United States Patent
Seol et al.

(10) Patent No.: US 11,732,712 B2
(45) Date of Patent: Aug. 22, 2023

(54) ROTARY COMPRESSOR

(71) Applicant: LG ELECTRONICS INC., Seoul (KR)

(72) Inventors: Seseok Seol, Seoul (KR); Jinung Shin, Seoul (KR); Joonhong Park, Seoul (KR)

(73) Assignee: LG ELECTRONICS INC.

( * ) Notice: Subject to any disclaimer, the term of this patent is extended or adjusted under 35 U.S.C. 154(b) by 94 days.

(21) Appl. No.: 17/562,175

(22) Filed: Dec. 27, 2021

(65) Prior Publication Data

US 2022/0243728 A1 Aug. 4, 2022

(30) Foreign Application Priority Data

Feb. 1, 2021 (KR) ..... 10-2021-0014240

(51) Int. Cl.

| | |
|---|---|
| ***F04C 2/344*** | (2006.01) |
| ***F04C 15/06*** | (2006.01) |
| ***F04C 18/356*** | (2006.01) |
| ***F04C 18/344*** | (2006.01) |
| ***F04C 29/12*** | (2006.01) |

(52) U.S. Cl.

CPC ..... *F04C 2/344* (2013.01); *F04C 15/06* (2013.01); *F04C 2240/30* (2013.01); *F04C 2240/50* (2013.01)

(58) Field of Classification Search

CPC ..... F04C 2/344; F04C 15/06; F04C 18/356; F04C 18/344; F04C 18/3446; F04C 29/12

See application file for complete search history.

(56) References Cited

U.S. PATENT DOCUMENTS

| | | | | |
|---|---|---|---|---|
| 6,176,687 | B1 * | 1/2001 | Kim | F04C 29/061 181/403 |
| 9,751,384 | B2 | 9/2017 | Shimaguchi et al. | |
| 2017/0175742 | A1 * | 6/2017 | Morishita | F04C 29/124 |

FOREIGN PATENT DOCUMENTS

| | | |
|---|---|---|
| CN | 1492151 | 4/2004 |
| CN | 105899810 | 8/2016 |
| CN | 110520624 | 11/2019 |

(Continued)

OTHER PUBLICATIONS

European Search Report issued in Application No. 21214988.4 dated Jul. 4, 2022.

(Continued)

*Primary Examiner* — Deming Wan
(74) *Attorney, Agent, or Firm* — Ked & Associates

(57) ABSTRACT

A rotary compressor may include a case, a cylinder, a roller, a vane, a main bearing and a sub bearing, and a discharge passage defined in the main bearing or the sub bearing to discharge refrigerant compressed in a compression space. The discharge passage may include at least one discharge hole formed through the main bearing or the sub bearing, and at least one discharge guide groove having a first end that communicates with the at least one discharge hole and a second end that extends from the at least one discharge hole toward a contact point between the cylinder and the roller and is recessed from one surface of the main bearing or the sub bearing forming the compression space. Accordingly, an amount of refrigerant remaining in the compression space even after a discharge stroke may be reduced.

20 Claims, 16 Drawing Sheets

(56) References Cited

FOREIGN PATENT DOCUMENTS

| | | |
|---|---|---|
| CN | 111287962 | 6/2020 |
| EP | 1 550 810 | 7/2005 |
| JP | 55-098687 | 7/1980 |
| JP | 59-096496 | 6/1984 |
| JP | 2001-248569 | 9/2001 |
| KR | 10-2006-0120389 | 11/2006 |
| KR | 10-2011-0004217 | 1/2011 |
| KR | 10-2019-0106275 | 9/2019 |
| KR | 10-2020-0061198 | 6/2020 |
| WO | WO 2004/029462 | 4/2004 |
| WO | WO 2018/194294 | 10/2018 |

OTHER PUBLICATIONS

Korean Office Action issued in Application No. 10-2021-0014240 dated Jan. 20, 2022.
Chinese Office Action issued in Application No. 202210030198.2 dated Mar. 28, 2023.

* cited by examiner

ROTARY COMPRESSOR

CROSS-REFERENCE TO RELATED APPLICATION(S)

Pursuant to 35 U.S.C. § 119(a), this application claims the benefit of the earlier filing date and the right of priority to Korean Patent Application No. 10-2021-0014240, filed in Korea on Feb. 1, 2021, the contents of which are incorporated by reference herein in their entirety.

BACKGROUND

1. Field

A rotary compressor, and more particularly, a vane rotary compressor in which a vane is slidably inserted into a roller is disclosed herein.

2. Background

A rotary compressor may be classified into two types, namely, a type in which a vane is slidably inserted into a vane groove of a cylinder such that a front surface of the vane comes into contact with an outer circumferential surface of a roller, and another type in which a vane is slidably inserted into a vane groove of a roller such that a front surface of the vane comes into contact with an inner circumferential surface of a cylinder. In general, the former is referred to as a 'rotary compressor' and the latter is referred to as a 'vane rotary compressor'.

An eccentric rotary compressor is disclosed in Korean Patent Publication No. 10-2006-0120389 (hereinafter "Patent Document 1"), which is hereby incorporated by reference. In Patent Document 1, a vane that is slidably inserted into a cylinder slides toward a roller by an elastic force or back pressure to come into contact with a front surface of the vane. Such a rotary compressor forms one compression chamber per rotation of the roller to perform suction, compression, and discharge strokes or cycles.

A vane rotary compressor is disclosed in U.S. Pat. No. 9,751,384 (hereinafter "Patent Document 2"), which is hereby incorporated by reference. In Patent Document 2, a plurality of vanes inserted into a roller slide by a centrifugal force and back pressure to come into contact with an inner circumferential surface of a cylinder while rotating together with the roller. Such a vane rotary compressor continuously forms compression chambers as many as a number of vanes per revolution of the roller, and each compression chamber sequentially performs suction, compression, and discharge strokes.

In the eccentric rotary compressor of Patent Document 1 as well as the vane rotary compressor of Patent Document 2, a gap (or interval) is generated between a discharge hole and a contact point in a circumferential direction, such that compressed refrigerant is not entirely discharged during the discharge stroke, and some of the refrigerant remains in a space between the discharge hole and the contact point, causing overcompression or excessive compression. This may result in increasing motor input to thereby reduce compressor efficiency.

In the related art vane rotary compressor, pressure on a front side of the vane is excessively increased due to overcompression of residual refrigerant, which causes vibration or shaking of the vane, such as chattering. As a result, vibration noise of the compressor may be increased and a front-end surface of the vane or the inner circumferential surface of the cylinder may be damaged. This may lead to a decrease in reliability of the compressor.

Also, in the related art vane rotary compressor, as shaking of the vane continues, refrigerant during a compression stroke may flow back into a suction stroke, which may heat refrigerant in the suction stroke. This may lead to an increase in specific volume, thereby reducing an amount of refrigerant suctioned. This may cause suction loss, and thus, compressor efficiency may be reduced.

In addition, in the related art vane rotary compressor, when a discharge hole is defined in the cylinder, as in Patent Document 2, surface pressure between a front surface of the vane at the discharge hole and an inner circumferential surface of the cylinder may be increased and not be uniform, causing abrasion of the inner circumferential surface of the cylinder. As a valve accommodation groove is defined in an outer circumferential surface of the cylinder, processing for the cylinder may be more complicated or difficult, thereby increasing manufacturing costs. Rigidity of the cylinder may be reduced due to the valve accommodation groove, which may cause shaking of the vane, thereby increasing vibration noise of the compressor.

Further, in the related art vane rotary compressor, when a plurality of vanes are slidably inserted into the roller, as in Patent Document 2, a circumferential distance between two discharge holes may be less (or shorter) than a circumferential distance between vanes. As the discharge stroke is shortened or reduced, more compressed refrigerant may remain after the final (or last) discharge stroke, which may further aggravate the above-described problem. Further, as refrigerant is intermittently discharged, pressure pulsation may be generated and compressor efficiency may be reduced. When the discharge hole is increased in size in consideration of this, the number or size of the discharge valves may be increased, thereby increasing manufacturing costs or reducing compression efficiency due to overcompression.

BRIEF DESCRIPTION OF THE DRAWINGS

Embodiments will be described in detail with reference to the following drawings in which like reference numerals refer to like elements, and wherein.

DETAILED DESCRIPTION

Hereinafter, a rotary compressor according to embodiments will be described with reference to the accompanying drawings. In this specification, the same or equivalent components may be provided with the same or similar reference numbers even in different embodiments, and description thereof will not be repeated. A singular representation may include a plural representation unless it represents a definitely different meaning from the context.

In describing the embodiments, if a detailed explanation for a related known function or construction is considered to unnecessarily divert from the main point of the embodiments, such explanation has been omitted but would be understood by those skilled in the art. Also, it should be understood that the accompanying drawings are merely illustrated to easily explain the concept, and therefore, they should not be construed to limit the technological concept disclosed herein by the accompanying drawings, and the concept should be construed as being extended to all modifications, equivalents, and substitutes included in the concept and technological scope.

In addition, unless clearly used otherwise, expressions in the singular number include a plural meaning.

Figure 1:
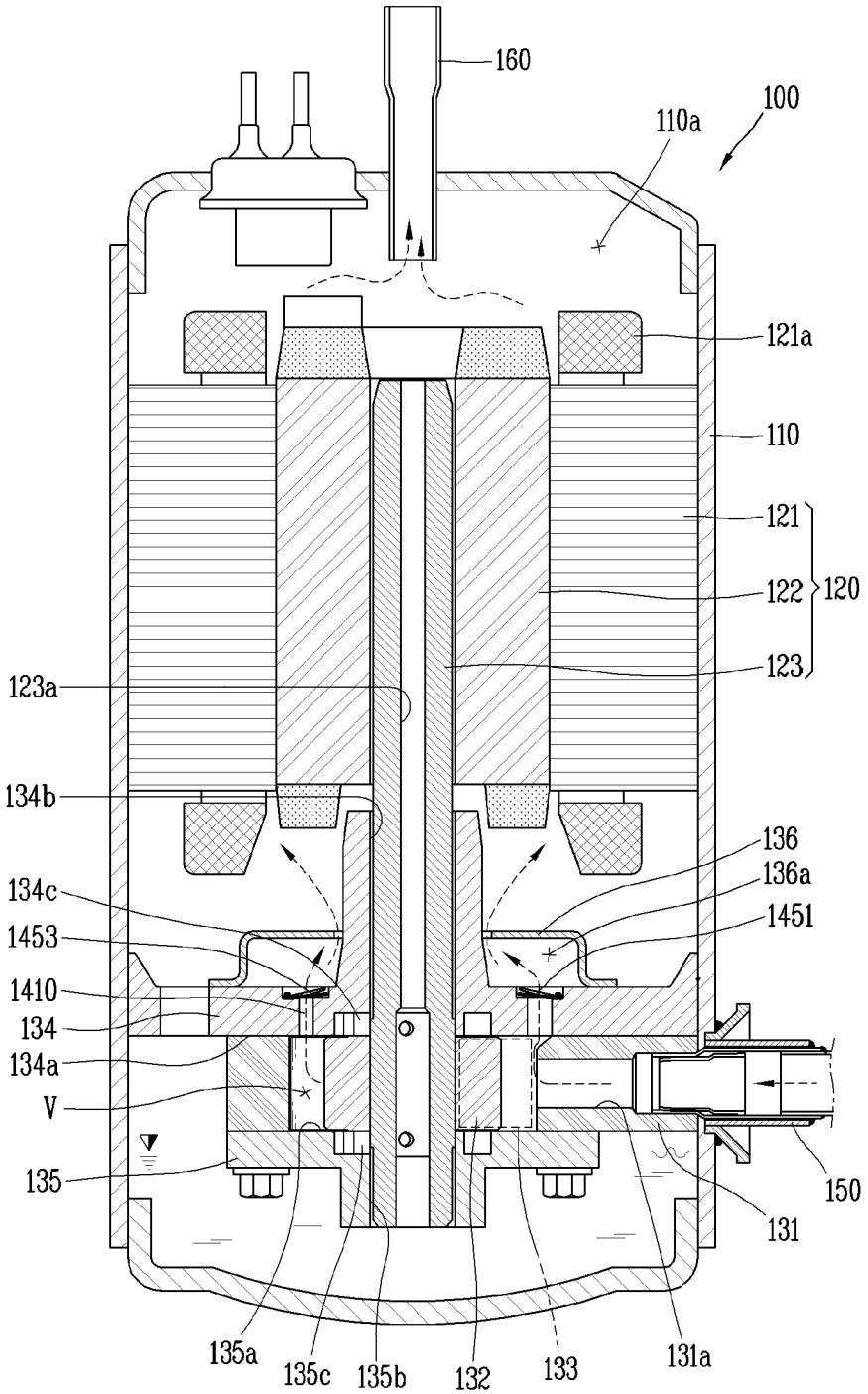
FIG. 1 is a cross-sectional view of an inside of a rotary compressor according to an embodiment.
Figure 2:
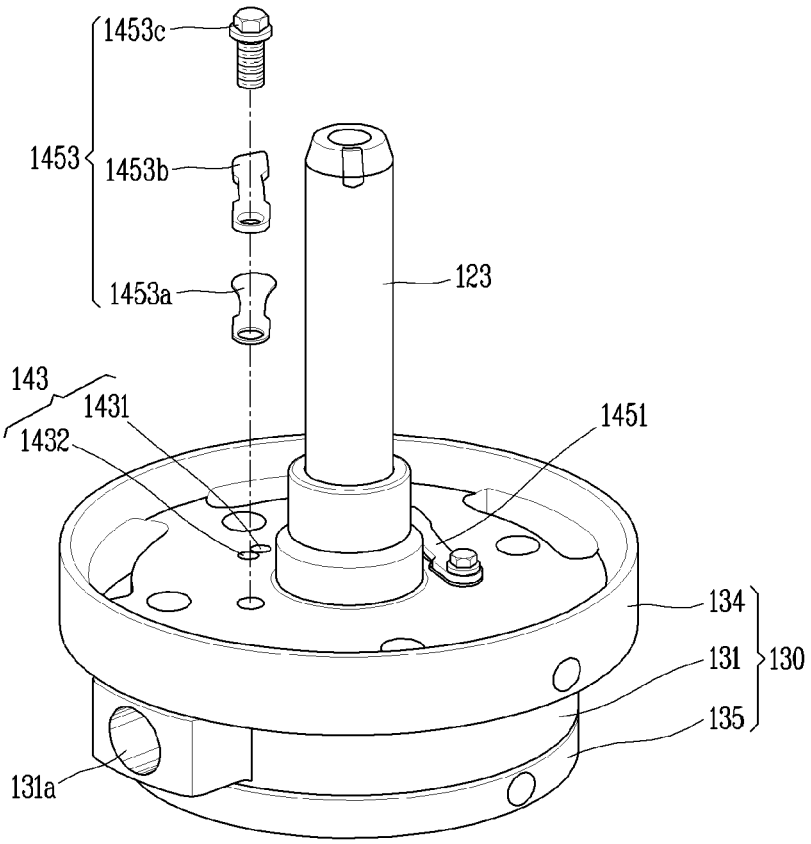
FIG. 2 is a perspective view of a compression unit of FIG. 1.
Figure 3:
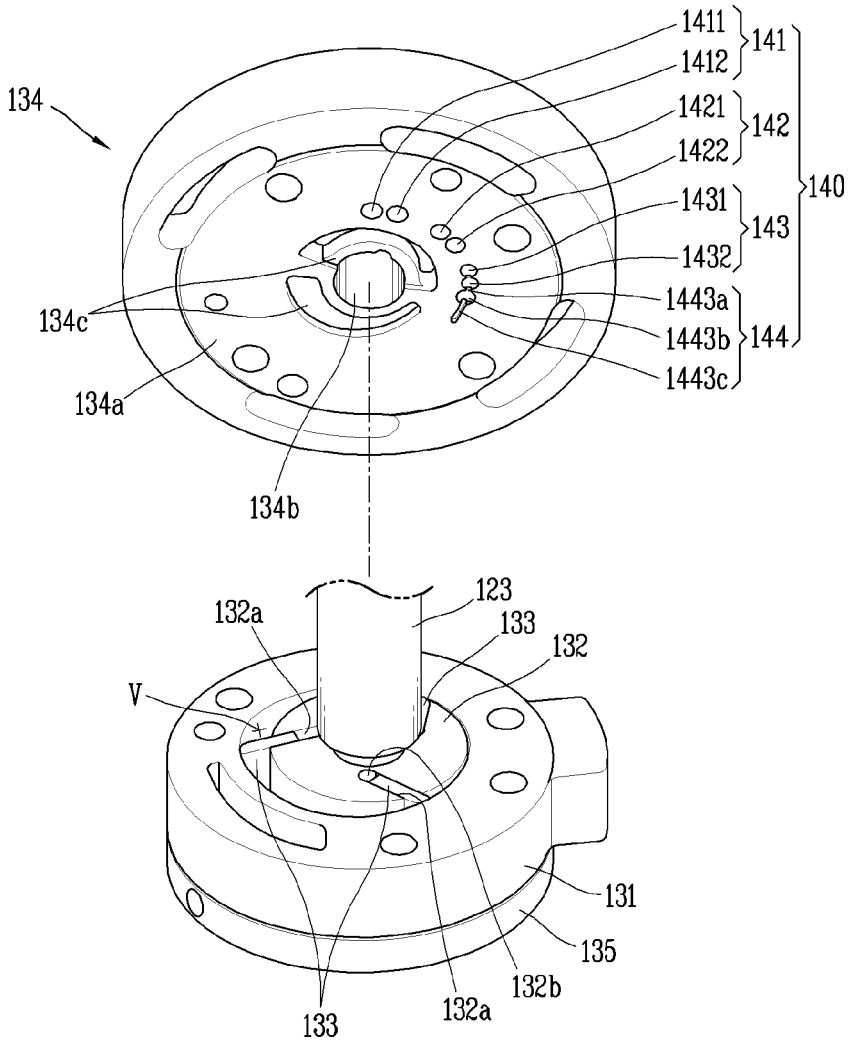
FIG. 3 is a disassembled perspective view illustrating a state in which a main bearing is disassembled from a cylinder of FIG. 2.

FIG. 1 is a cross-sectional view of an inside of a rotary compressor according to an embodiment. FIG. 2 is a perspective view of a compression unit of FIG. 1. FIG. 3 is a disassembled perspective view illustrating a state in which a main bearing is disassembled from a cylinder of FIG. 2.

Referring to FIGS. 1 and 3, a rotary compressor 100 according to this embodiment may include a case 110, a motor unit (motor) 120, and a compression unit 130. The case 110 may include a hermetically sealed inner space 110*a* and extend lengthwise in an axial direction, and the motor unit 120 and the compression unit 130 may be installed at both sides in the axial direction of the inner space 110*a* of the case 110, respectively. For example, the motor unit 120 may be disposed at an upper side of the inner space 110*a* of the case 110, and the compression unit 130 may be disposed at a lower side of the inner space 110*a* of the case 110.

The motor unit 120 according to this embodiment may include a stator 121 and a rotor 122. The stator 121 may have a cylindrical shape and be fixed to an inner circumferential surface of the case 110. A coil 121*a* that generates a magnetic force may be wound around the stator 121.

The rotor 122 may have a cylindrical shape to be rotatably provided in the stator 121. A rotational shaft 123 that transmits a rotational force of the motor unit 120 to the compression unit 130 may be press-fitted into a center of the rotor 122.

The rotational shaft 123 may be supported by being rotatably inserted into a main bearing hole 134*b* of a main bearing 134 and a sub bearing hole 135*b* of a sub bearing 135. The rotational shaft 123 may be formed in a cylindrical shape having one (first) end coupled to the rotor 122 and another (second) end coupled to a roller 132 described hereinafter or integrally formed with the roller 132.

The compression unit 130 according to this embodiment may include a cylinder 131, the roller 132, a vane 133, the main bearing 134, and the sub bearing 135. The cylinder 131 may have an annular shape with a hollow portion, and the hollow portion may define a compression space V together with the main bearing 134 and the sub bearing 135 described hereinafter. A suction port 131*a* that penetrates from an outer circumferential surface of the cylinder 131 to an inner circumferential surface of the hollow portion may be formed at one side of the cylinder 131.

An inner circumferential surface of the cylinder 131 defining the compression space V may have a circular shape, or a symmetric or asymmetric elliptical (or oval) shape. This embodiment illustrates an example in which the inner circumferential surface of the cylinder 131 has an asymmetric elliptical shape.

A center of the outer circumferential surface of the cylinder 131 may be located on a same axis as the rotational shaft 123, and a center of the inner circumferential surface of the cylinder 131 may be eccentric with respect to an axial center O of the rotational shaft 123. Accordingly, the compression space V may be eccentric with respect to the axial center O of the rotational shaft 123.

As described above, the roller 132 may be press-fitted into the rotational shaft 123 to be assembled with or formed as a single body with the rotational shaft 123. This embodiment illustrates an example in which the roller 132 is assembled to the rotational shaft 123.

The roller 132 may have a circular outer circumferential surface to be located on the same axis as the rotational shaft 123. Accordingly, the roller 132 is eccentric with respect to the compression space V, and one point of the outer circumferential surface of the roller 132 comes into line contact with the inner circumferential surface of the cylinder 131, allowing a volume of the compression space V to be changed.

A portion or point at which the outer circumferential surface of the roller 132 comes into contact with the inner circumferential surface of the cylinder 131 may be referred to as a 'contact point' P. The outer circumferential surface of the roller 132 comes into line contact with the inner circumferential surface of the cylinder 131 at the contact point P to divide the compression space V into a suction section and a discharge section.

A plurality of vane grooves 132*a* may be formed on the outer circumferential surface of the roller 132. The plurality of vane grooves 132*a* may be disposed at predetermined intervals along the outer circumferential surface of the roller 132. Each vane groove 132*a* may be formed through both surfaces of the roller 132 in the axial direction.

The vane groove 132*a* may be defined in a radial direction or inclined by a predetermined angle with respect to the radial direction. This embodiment illustrates an example in which the vane groove 132*a* is inclined by a predetermined angle with respect to the radial direction.

Back pressure chambers 132*b* may be formed at inner ends of the vane grooves 132*a*, respectively. Like the vane groove 132*a*, the back pressure chamber 132*b* may each be formed through both surfaces of the roller 132 in the axial direction. Accordingly, each of the back pressure chambers 132*b* may communicate with a main back pressure pocket 134*c* provided at a lower surface 134*a* of the main bearing 134, and a sub back pressure pocket 135*c* provided at an upper surface 135*a* of the sub bearing 135 and faces the main back pressure pocket 134*c*. Accordingly, oil introduced into the back pressure pockets 134*c* and 135*c* may flow into the back pressure chambers 132*b*, and thus, the vanes 133 may be pressed toward the inner circumferential surface of the cylinder 131 according to oil pressure of the respective back pressure chambers 132*b*.

The vanes 133 may each have a substantially cuboid shape to be slidably inserted into the vane grooves 132*a*, respectively. A front surface of each vane 133 facing the inner circumferential surface of the cylinder 131 may have a curved shape that is curved in a reverse rotational direction of the roller 132, and a rear surface of the vane 133 may be flat such that oil pressure transmitted from the back pressure chamber 132*b* may be evenly or uniformly applied. However, in some cases, the front surface of the vane 133 may be evenly curved in both rotational directions of the roller 132, and the rear surface of the vane 133 may be inclined or stepped in consideration of a pressure difference between compression chambers.

Unexplained reference numerals 150 and 160 are a suction pipe and a discharge pipe, respectively.

Figure 4:
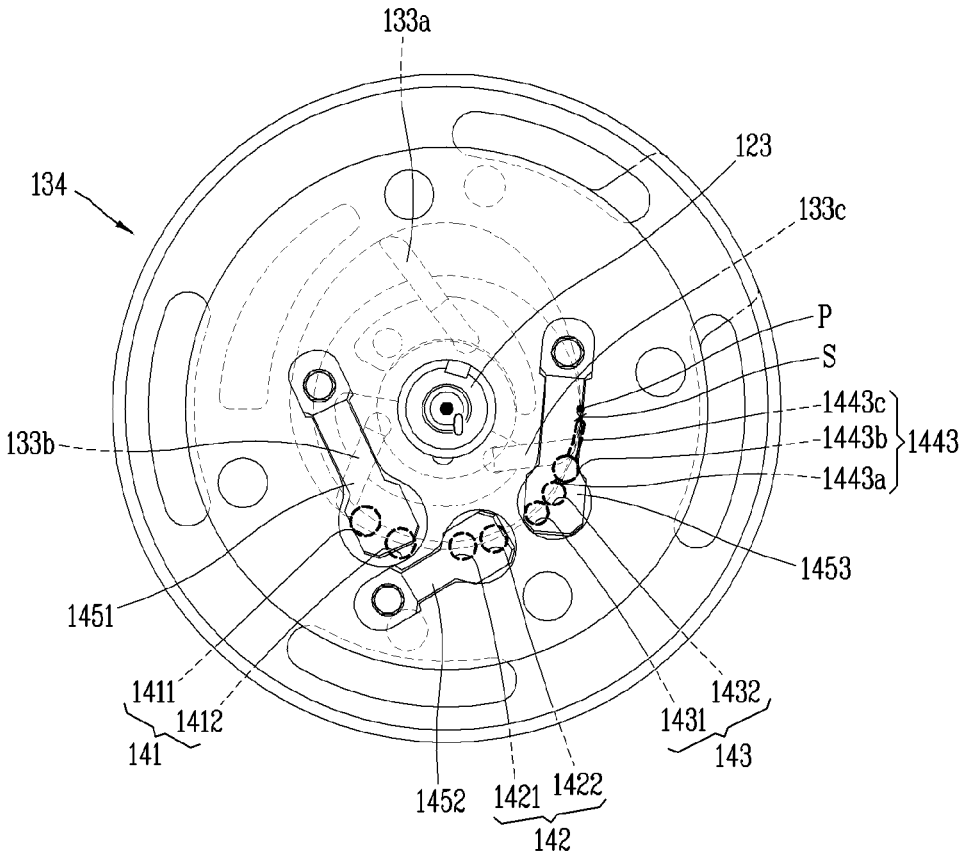
FIG. 4 is a top planar view of the main bearing of FIG. 3.
Figure 5:
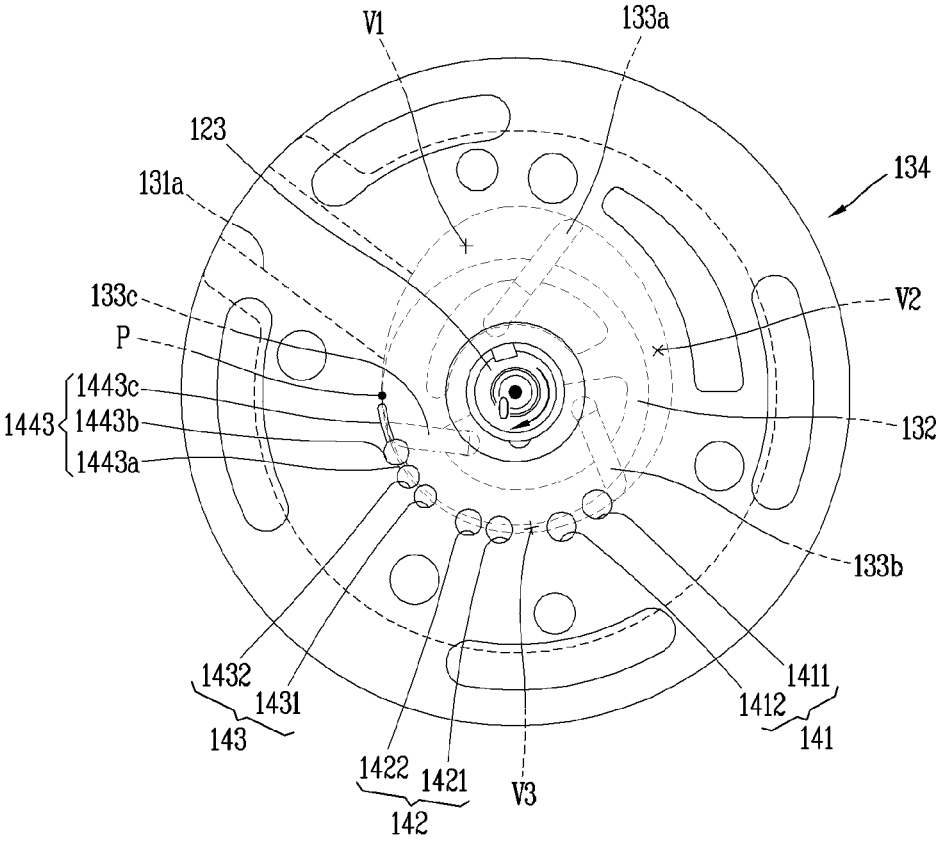
FIG. 5 is a bottom planar view of the main bearing of FIG. 3.

FIG. 4 is a top planar view of the main bearing of FIG. 3. FIG. 5 is a bottom planar view of the main bearing of FIG. 3.

Referring to FIGS. 4 and 5, the main bearing 134 may have a disk shape and be provided at its center with the main bearing hole 134*b* formed therethrough. The rotational shaft 123 may be formed through the main bearing hole 134*b* to be supported in the radial direction.

A plurality of main back pressure pockets 134*c* may be provided at the lower surface 134*a* of the main bearing 134 along a circumference of the main bearing hole 134*b*. The main back pressure pockets 134*c* may each have an arcuate shape. One of the (first) main back pressure pockets 134*c* may directly communicate with an oil flow path 123*a* of the rotational shaft 123 to form discharge pressure, whereas another one of the (second) main back pressure pockets 134*c* may be blocked with respect to the oil flow path 123*a* of the rotational shaft 123 to form an intermediate pressure.

A discharge passage 140 through which refrigerant compressed in the compression space V is discharged to the inner space 110*a* of the case 110 may be formed in the main bearing 134. The discharge passage 140 may be located further outside than the main back pressure pockets 134*c*, more precisely, near the inner circumferential surface of the cylinder 131. As the discharge passage 140 is defined in the main bearing 134 (or sub bearing) rather than in the cylinder 131, a structure of the cylinder 131 may be simplified, thereby facilitating processing. In addition, a surface pressure between the front surface of the vane 133 in a vicinity of discharge holes and the inner circumferential surface of the cylinder 131 facing the front surface of the vane 133 may not only be reduced but also maintained constant. Further, shaking of the vane 133 may be reduced, thereby suppressing abrasion and vibration noise between the vane 133 and the cylinder 131.

One discharge passage 140 may be provided, or a plurality of discharge passages 140 may be provided spaced apart from one another by predetermined intervals. This embodiment will be described based on an example in which a plurality of discharge passages 140 is disposed at predetermined intervals.

Referring to FIGS. 4 and 5, the discharge passage 140 according to this embodiment may include a first discharge part (discharge) 141, a second discharge part (discharge) 142, and a third discharge part (discharge) 143. For the sake of convenience, a discharge part (discharge) which is closest to the suction port 131*a* will be referred to as the first discharge part 141, and a discharge part which is farthest away from the suction port 131*a* and located adjacent to the contact point P will be referred to as the third discharge part 143.

The first discharge part 141, the second discharge part 142, and the third discharge part 143 may each include a pair of discharge holes. However, the discharge holes of each of the discharge parts 141, 142, and 143 may be formed differently according to, for example, a discharge pressure or a discharge valve described hereinafter. Hereinafter, description will be given based on an example in which each of the discharge parts 141, 142, and 143 includes two discharge holes.

The first discharge part 141 may include a first discharge hole 1411 and a second discharge hole 1412 formed through both surfaces of the main bearing 134 in the axial direction. The first discharge hole 1411 and the second discharge hole 1412 may be identically formed. For example, an inner diameter of the first discharge hole 1411 and an inner diameter of the second discharge hole 1412 may be equal to each other.

The first discharge hole 1411 and the second discharge hole 1412 may be spaced apart from each other by a predetermined interval or distance along the rotational direction of the roller 132 (the direction of the arrow in FIG. 5). For example, an interval between the first discharge hole 1411 and the second discharge hole 1412 may be defined such that the first discharge hole 1411 and the second discharge hole 1412 may be opened and closed by one first valve member (valve) 1451, namely, the interval between the first discharge hole 1411 and the second discharge hole 1412 may be smaller (or less) than the inner diameter of the first discharge hole 1411 or the inner diameter of the second discharge hole 1412.

Although not illustrated in the drawings, the first discharge hole 1411 and the second discharge hole 1412 may be opened and closed by respective valve members (valves). In this case, an interval between the first discharge hole 1411 and the second discharge hole 1412 may not necessarily be smaller than the inner diameter of the first discharge hole 1411 or the inner diameter of the second discharge hole 1412.

The second discharge part 142 may include a third discharge hole 1421 and a fourth discharge hole 1422 formed through both surfaces of the main bearing 134 in the axial direction. The third discharge hole 1421 and the fourth discharge hole 1422 may be identically formed. For example, an inner diameter of the third discharge hole 1421 and an inner diameter of the fourth discharge hole 1422 may be equal to each other.

In addition, the inner diameter of each of the third discharge hole 1421 and the fourth discharge hole 1422 may be less than the inner diameter of the first discharge hole 1411 and the inner diameter of the second discharge hole 1412. Accordingly, cross-sectional areas of the discharge holes of the second discharge part 142 may be smaller than cross-sectional areas of the discharge holes of the first discharge part 141.

The third discharge hole 1421 and the fourth discharge hole 1422 may be spaced apart from each other by a predetermined interval along the rotational direction of the roller 132. For example, an interval between the third discharge hole 1421 and the fourth discharge hole 1422 may be defined such that the third discharge hole 1421 and the fourth discharge hole 1422 may be opened and closed by one second valve member (valve) 1452, namely, the interval between the third discharge hole 1421 and the fourth discharge hole 1422 may be smaller than the inner diameter of the third discharge hole 1421 or the inner diameter of the fourth discharge hole 1422.

Although not illustrated in the drawings, the third discharge hole 1421 and the fourth discharge hole 1422 may be opened and closed by respective valve members (valves). In this case, an interval between the third discharge hole 1421 and the fourth discharge hole 1422 may not necessarily be smaller than the inner diameter of the third discharge hole 1421 or the inner diameter of the fourth discharge hole 1422.

The third discharge part 143 may include a fifth discharge hole 1431 and a sixth discharge hole 1432 formed through both surfaces of the main bearing 134 in the axial direction. The fifth discharge hole 1431 and the sixth discharge hole 1432 may be identically formed. For example, an inner diameter of the fifth discharge hole 1431 and an inner diameter of the sixth discharge hole 1432 may be equal to each other.

In addition, the inner diameter of the fifth discharge hole 1431 and the inner diameter of the sixth discharge hole 1432 may be smaller than the inner diameter of the third discharge hole 1421 and the inner diameter of the fourth discharge hole 1422. Accordingly, cross-sectional areas of the discharge holes 1431 and 1432 defining the third discharge part 143 may be smaller than the cross-sectional areas of the discharge holes 1411 and 1412 defining the first discharge part 141 and the cross-sectional areas of the discharge holes 1421 and 1421 defining the second discharge part 142.

The fifth discharge hole 1431 and the sixth discharge hole 1432 may be spaced apart from each other by a predetermined interval along the rotational direction of the roller 132. For example, an interval between the fifth discharge hole 1431 and the sixth discharge hole 1432 may be defined such that the fifth discharge hole 1431 and the sixth discharge hole 1432 may be opened and closed by one third valve member (valves) 1453, namely, the interval between the fifth discharge hole 1431 and the sixth discharge hole 1432 may be smaller than the inner diameter of the fifth discharge hole 1431 or the inner diameter of the sixth discharge hole 1432.

Although not illustrated in the drawings, the fifth discharge hole 1431 and the sixth discharge hole 1432 may be opened and closed by respective valve members (valves). In this case, an interval between the fifth discharge hole 1431 and the sixth discharge hole 1432 may not necessarily be smaller than the inner diameter of the fifth discharge hole 1431 or the inner diameter of the sixth discharge hole 1432.

At least one of the first discharge part 141, the second discharge part 142, or the third discharge part 143 may further include a discharge guide groove that extends from a discharge hole of the corresponding discharge part. Accordingly, residual refrigerant that is not discharged until the vane 133 passes through the discharge hole of the corresponding discharge part may be discharged, thereby suppressing overcompression. The discharge guide groove will be described hereinafter.

In addition, the valve members (valves) 1451, 1452, 1453 configured to open and close the respective discharge holes 1411 and 1412, 1421 and 1422, and 1431 and 1432 may be provided at outlet (or exit) sides of the first discharge part 141, the second discharge part 142, and the third discharge part 143, respectively. Accordingly, refrigerant may be compressed in each compression space V up to a predetermined discharge pressure and be then discharged to the inner space 110*a* of the case 110.

Referring to FIGS. 2 and 4, one valve member 1451, 1452, and 1453 may be provided to open and close the respective plurality of discharge holes 1411 and 1412, 1421 and 1422, and 1431 and 1432 collectively, or a plurality of valve members 1451, 1452, 1453 may be provided to open and close the respective plurality of discharge holes 1411 and 1412, 1421 and 1422, and 1431 and 1432 individually. This embodiment illustrates an example in which the valve members 1451, 1452, and 1453 are each provided as one to open and close the respective plurality of discharge holes 1411 and 1412, 1421 and 1422, and 1431 and 1432 collectively. As the plurality of valve members 1451, 1452, and 1453 is identically formed, the third valve member 1453 that opens and closes the third discharge part 143 will be used as a representative example for description.

The third valve member 1453 according to this embodiment may include (one) discharge valve 1453*a*, (one) retainer 1453*b*, and (one) bolt 1453*c*. The discharge valve 1453*a* may have one (first) end which is fixed to the main bearing 134 by the bolt 1453*c* and another (second) end which is free to open and close the discharge holes 1431 and 1432 defining the third discharge part 143 while rotating about the bolt 1453*c*. The retainer 1453*b* may have one (first) end which is fixed to the main bearing 134, together with the discharge valve 1453*a*, by the bolt 1453*c* and another (second) end which is curved such that the fifth discharge hole 1431 and the sixth discharge hole 1432 may be opened and closed collectively as the free end of the discharge valve 1453*a* is bent.

Although not illustrated in the drawings, the valve member may be configured as different types other than the reed valve described above. For example, the valve member may be configured as a ball valve that is opened and closed by being inserted into each of the discharge holes, or a piston valve.

The rotary compressor according to this embodiment may operate as follows.

That is, when power is applied to the coil 121*a* of the stator 121 of the motor unit 120, the rotor 122 of the motor unit 120 and the rotational shaft 123 coupled to the rotor 122 rotate, causing the roller 134 which is coupled to the rotational shaft 123 or integrally formed with the rotational shaft 123 to rotate together with the rotational shaft 123. Then, the plurality of vanes 133 slidably inserted into the roller 134 is pulled or drawn out from the respective vane grooves 132*a* by a centrifugal force generated by rotation of the roller 132 and back pressure of the back pressure chambers 132*b* provided at rear sides of the vanes 133, or is drawn into the respective vane grooves 132*a*, allowing each of the vanes 133 to be in contact with the inner circumferential surface of the cylinder 131.

The compression space V of the cylinder 131 is divided by the plurality of vanes 133 into a plurality of compression chambers (including a suction chamber and a discharge chamber) V1, V2, and V3 as many as the number of vanes 133. A volume of each of the compression chambers V1, V2, and V3 changes according to a shape of the inner circumferential surface of the cylinder 131 and eccentricity of the roller 132 while moving in response to the rotation of the roller 132. Refrigerant filled in each of the compression chambers V1, V2, and V3 flows along the roller 132 and the vanes 133 to be suctioned, compressed, and discharged. Such series of processes are repeated.

At this time, as a distance between the inner circumferential surface of the cylinder 131 and the outer circumferential surface of the roller 132 is drastically reduced when approaching the contact point P, the third discharge part 143, which is the last (or final) discharge part, is formed to be spaced apart from the contact point P by a predetermined interval. Accordingly, a refrigerant remaining space S, which is a space in which residual refrigerant remains, is formed between the third discharge part 143 and the contact point P, and refrigerant that is not discharged from the third discharge part 143 remains in the refrigerant remaining space S. This may cause overcompression in the refrigerant remaining space S, thereby reducing compressor efficiency.

In order to prevent this, a discharge guide part (guide) 144 that extends from the third discharge part 143 in a direction toward the contact point P may be further provided to allow refrigerant remaining in the refringent remaining space S to be discharged through the third discharge part 143. Accordingly, residual refrigerant in the refrigerant remaining space S may be suppressed or minimized to thereby suppress a decrease in compressor efficiency due to overcompression of refrigerant.

Figure 6:
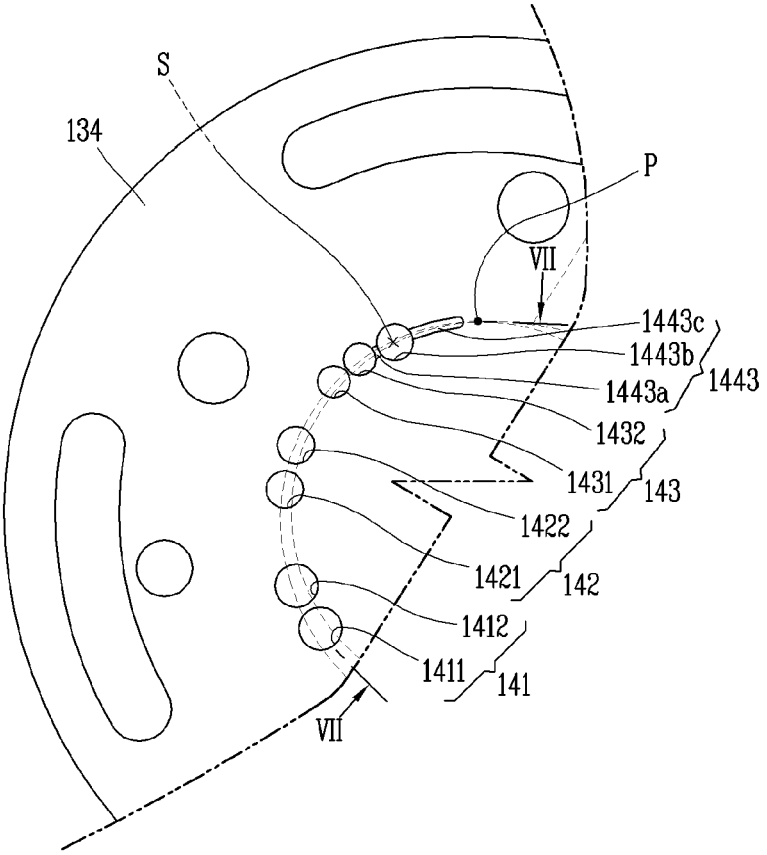
FIG. 6 is a partially enlarged view of a discharge passage of FIG. 5 according to an embodiment.
Figure 7:
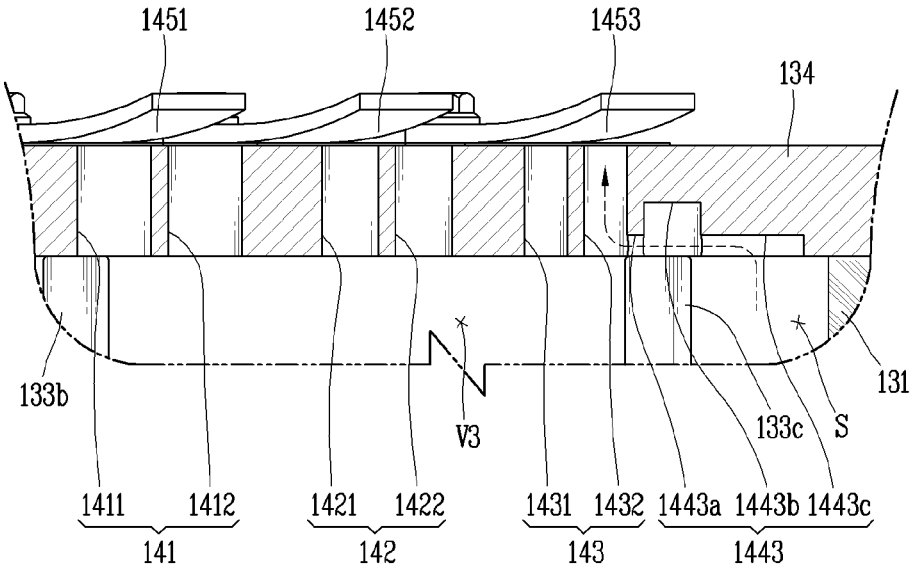
FIG. 7 is a cross-sectional view, taken along line "VII-VII" in FIG. 6.
Figure 8:
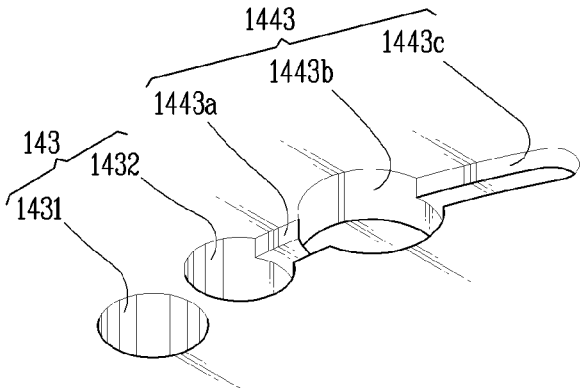
FIG. 8 is an enlarged perspective view illustrating a discharge hole and a discharge guide groove of FIG. 5.
Figure 9:
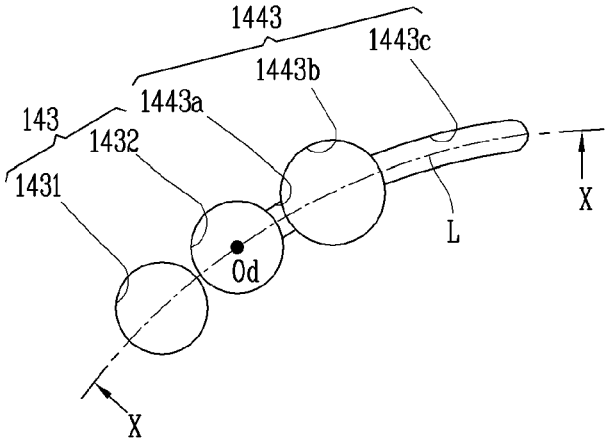
FIG. 9 is a planer view of the discharge hole and discharge guide groove of FIG. 8.
Figure 10:
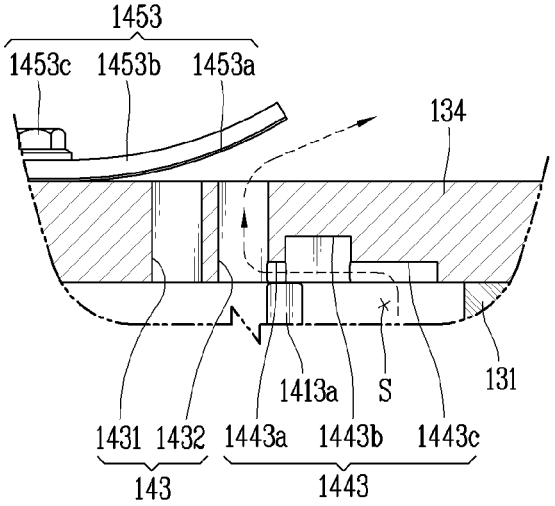
FIG. 10 is a cross-sectional view, taken along line "X-X" in FIG. 9.

FIG. 6 is a partially enlarged view of a discharge passage of FIG. 5 according to an embodiment. FIG. 7 is a cross-sectional view, taken along line "VII-VII" of FIG. 6. FIG. 8 is an enlarged perspective view illustrating a discharge hole and a discharge guide groove of FIG. 5. FIG. 9 is a planer view of the discharge hole and discharge guide groove of FIG. 8. FIG. 10 is a cross-sectional view, taken along line "X-X" of FIG. 9.

Referring to FIGS. 6 to 10, the discharge guide part 144 according to this embodiment may be recessed from the lower surface 134*a* of the main bearing 134 by a predetermined depth. That is, the discharge guide part 144 according to this embodiment may include a first discharge guide groove 1443*a*, a second discharge guide groove 1443*b*, and a third discharge guide groove 1443*c*. However, instead of the plurality of discharge guide grooves, the discharge guide part 144 may be configured as a single discharge guide groove extending long (lengthwise) in a circumferential direction. Hereinafter, description will be given based on the discharge guide part 144 including a plurality of discharge guide grooves.

The first discharge guide groove 1443*a* may extend from the sixth discharge hole 1432 in the circumferential direction. For example, the first discharge guide groove 1443*a* may be formed in the shape of a short arc having one (first) end connected to the sixth discharge hole 1432 and another (second) end connected to an inner circumferential surface of the second discharge guide groove 1443*b*. Accordingly, residual refrigerant introduced into the second discharge guide groove 1443*b* may be quickly guided to the sixth discharge hole 1432.

A radial width of the first discharge guide groove 1443*a* may be less than a radial width of the sixth discharge hole 1432. However, the radial width of the first discharge guide groove 1443*a* may be equal to the radial width of the sixth discharge hole 1432, and in some cases, greater than the radial width of the sixth discharge hole 1432. Accordingly, residual refrigerant introduced into the second discharge guide groove 1443*b* may flow more rapidly to the sixth discharge hole 1432.

The second discharge guide groove 1443*b* may be spaced apart from the sixth discharge hole 1432 by a predetermined interval toward the contact point P, and communicate with the sixth discharge hole 1432 via the first discharge guide groove 1443*a*. The second discharge guide groove 1443*b* may have a circular cross-sectional shape in axial projection and be formed as large as possible. For example, an inner diameter of the second discharge guide groove 1443*b* may be greater (or larger) than an inner diameter of the sixth discharge hole 1432. Accordingly, residual refrigerant in the refrigerant remaining space S may be quickly introduced into the second discharge guide groove 1443*b* to thereby flow to the sixth discharge hole 1432 through the first discharge guide groove 1443*a*.

The third discharge guide groove 1443*c* may have an arcuate cross-sectional shape when projected in the axial direction. For example, the third discharge guide groove 1443*c* may extend long (lengthwise) in a direction toward the contact point P from the second discharge guide groove 1443*b*.

One (first) end of the third discharge guide groove 1443*c* may be connected to the inner circumferential surface of the second discharge guide groove 1443*b*, and another (second) end of the third discharge guide groove 1443*c* may be spaced apart from the contact point P but extend to be as close as possible to the contact point P. As the end of the discharge guide 144 is close to the contact point P, refrigerant remaining in the refrigerant remaining space S may be quickly moved to the sixth discharge hole 1432.

The third discharge guide groove 1443*c* may have a width constant in the circumferential direction, as shown in FIG. 9. For example, the third discharge guide groove 1443*c* may extend in the shape of an arc along the circumferential direction and be left and right (laterally) symmetric with respect to an extension line L that extends from a center Od of the sixth discharge hole 1432 in the circumferential direction. Accordingly, an axial cross-sectional area of the third discharge guide groove 1443*c* may be secured and simultaneously facilitate processing to thereby suppress an increase in manufacturing costs.

The third discharge guide groove 1443*c* may have a cross-sectional area that is constant (same) or varies (differs) along a depth or depthwise direction.

Figure 11:
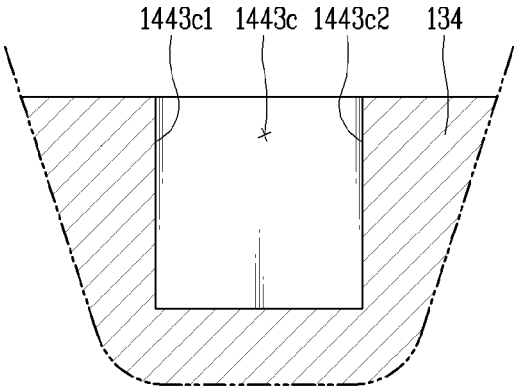
FIGS. 11 and 12 are cross-sectional views of an inner surface of a discharge guide groove according to an embodiment.
Figure 12:
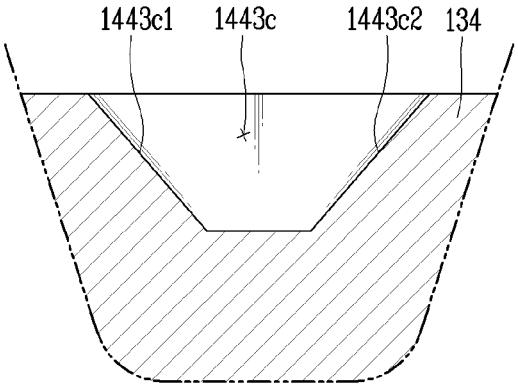

FIGS. 11 and 12 are cross-sectional views of an inner surface of a discharge guide groove according to an embodiment. Referring to FIG. 11, the third discharge guide groove 1443*c* may have a radial width that is constant along the depthwise direction. For example, a distance between an inner circumferential surface 1443*c*1 and an outer circumferential surface 1443*c*2 of the third discharge guide groove 1443*c* may be constant in the axial direction. Accordingly, the third discharge guide groove 1443*c* may have a large volume in overall relative to the same cross-sectional area.

Referring to FIG. 12, the third discharge guide groove 1443*c* may have a radial width that varies along the depthwise direction. For example, a distance between the inner circumferential surface 1443*c*1 and the outer circumferential surface 1443*c*2 of the third discharge guide groove 1443*c* may gradually decrease along the axial direction. This may facilitate processing of the third discharge guide groove 1443*c*. However, in this case, a radial width at an inlet (or entry) side of the third discharge guide groove 1443*c* may be greater than the radial width in FIG. 11, for example, substantially equal to the inner diameter of the second discharge guide groove 1443*b*.

Although not illustrated in the drawings, the third discharge guide groove 1443*c* may be formed in multiple stages along the depthwise direction such that a distance between the inner and outer circumferential surfaces gradually decreases along the axial direction.

The first discharge guide groove 1443*a*, the second discharge guide groove 1443*b*, and the third discharge guide groove 1443*c* may have a same depth. However, as the first discharge guide groove 1443*a* is a space that serves as a communication path or passage, it may not necessarily be deep. On the other hand, as the second discharge guide groove 1443*b* is formed in a largest area of the refrigerant remaining space S, it may be substantially greater in depth than the first discharge guide groove 1443*a* or the third discharge guide groove 1443*c*. In addition, as the third discharge guide groove 1443*c* is defined in a smallest area of the refrigerant remaining space S, the third discharge guide groove 1443*c* may be substantially lower in depth than the second discharge guide groove 1443*b*.

The discharge guide part according to this embodiment may operate as follows.

Referring back to FIGS. 4 and 5, as vanes 133*a*, 133*b*, and 133*c* rotate together with the roller 132, corresponding compression chambers V1, V2, and V3 pass through the first discharge part 141, the second discharge part 142, and the third discharge part 143, thereby sequentially passing from the first discharge hole 1411 to the sixth discharge hole 1432. Most of refrigerant compressed in the compression chambers V1, V2, and V3 is discharged to the inner space 110*a* of the case 110 through the respective discharge holes 1411 to 1432.

However, some of the refrigerant is not discharged even after passing through the third discharge part 143 and remains in the refrigerant remaining space S between the third discharge part 143 and the contact point P. This residual refrigerant may cause overcompression, thereby increasing the motor input or make vane movement unstable.

Therefore, in this embodiment, the discharge guide part 144 is provided at the rear of the third discharge part 143 to allow refrigerant remaining in the refrigerant remaining space S to be discharged to the third discharge part 143. That is, when the discharge guide part 144 communicates with the sixth discharge hole 1432 defining the third discharge part 143 and extends further toward the contact point P, as illustrated in FIG. 7, refrigerant remaining in the refrigerant remaining space S may flow back to the sixth discharge hole 1432 through the discharge guide part 144 and then be discharged to the inner space 110*a* of the case 110. This allows high-pressure refrigerant remaining in the refrigerant remaining space S to be minimized, thereby reducing the motor input or suppressing the unstable behavior of the vane. As refrigerant in the refrigerant remaining space is discharged to the inner space of the case even after a discharge stroke (or cycle), residual refrigerant in the refrigerant remaining space may be minimized, thereby reducing the amount of refrigerant remaining in the compression space.

In addition to the discharge holes, the discharge guide part may be further provided to form the discharge passage, an effective discharge area of discharging compressed refrigerant to the inner space of the case may be increased, which allows refrigerant compressed in the compression chamber to be discharged more quickly. As a result, overcompression loss may be suppressed.

As high-pressure refrigerant is suppressed from remaining in the refrigerant remaining space, pressure acting on the front surface of the vane may be uniform or equalized. Thus, a pressure difference at the front and rear surfaces of the vane may be resolved to thereby prevent vane jumping. In addition, wear or abrasion of the front surface of the vane or the inner circumferential surface of the cylinder that faces the front surface of the vane may be suppressed, and at the same time, reduce vibration noise caused by vibration or shaking of the vane. Further, high-pressure refrigerant may be suppressed from flowing into the suction side by passing through the contact point to thereby reduce suction loss. This may be particularly effective or beneficial when high-pressure refrigerant, such as R32, R410a, and CO2, is used in the rotary compressor according to embodiments.

Hereinafter, description will be given of a shape of a discharge guide groove according to another embodiment. That is, in the previous embodiment, the third discharge guide groove defining the discharge guide part is formed in the arcuate shape, but in some cases, the third discharge guide groove may have other various shapes.

Figure 13:
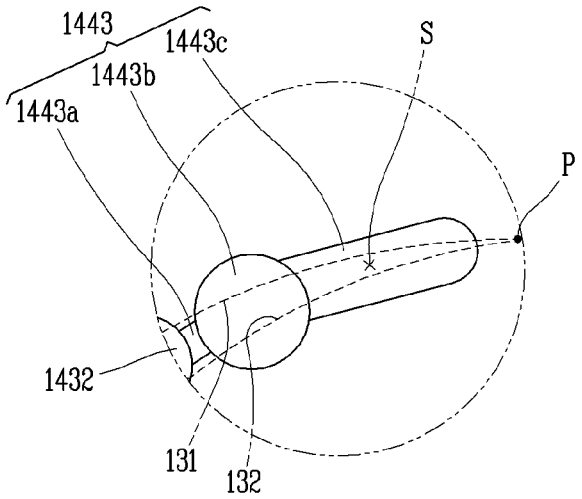
FIGS. 13 to 15 are enlarged planar views illustrating examples of a shape of a discharge guide groove according to an embodiment.
Figure 14:
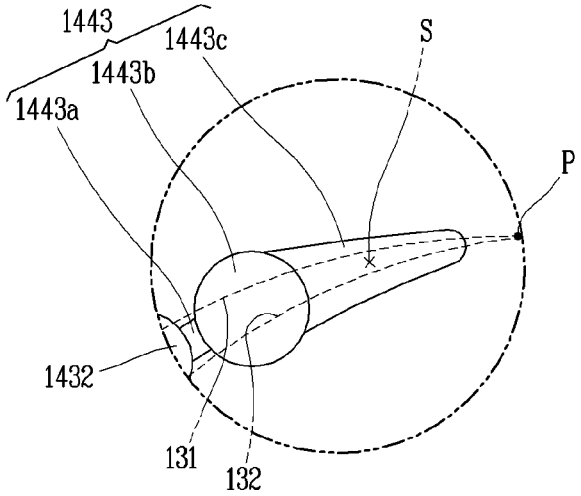
Figure 15:
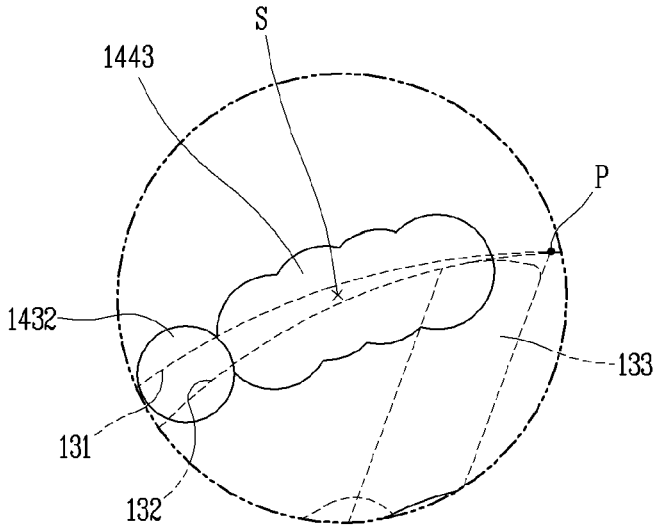

FIGS. 13 to 15 are enlarged planar views illustrating examples of a shape of a discharge guide groove according to embodiments. Referring to FIG. 13, third discharge guide groove 1443*c* may extend in the shape of a linear cross-section along the circumferential direction. For example, the third discharge guide groove 1443*c* may extend linearly from one surface of the sixth discharge hole 1432 toward the contact point P.

In this case, the third discharge guide groove 1443*c* may have a radial width that is constant along the circumferential direction, or a radial width that gradually decreases toward the contact point P. In addition, the third discharge guide groove 1443*c* may have a cross-sectional area that is constant along the axial direction, or a cross-sectional area that is inclined to be narrower (or gradually decrease).

As an operating effect of the third discharge guide groove 1443*c* according to this embodiment is similar to that of the previous embodiment, repetitive description thereof has been omitted. However, in this embodiment, as the third discharge guide groove 1443*c* has the linear shape, the third discharge guide groove 1443*c* may be more easily processed.

Referring to FIG. 14, the third discharge guide groove 1443*c* may extend in the shape of a wedge cross-section along the circumferential direction. For example, the third discharge guide groove 1443*c* may extend such that its radial width gradually decreases toward the contact point P from one surface of the sixth discharge hole 1432. In this case, the third discharge guide groove 1443*c* may have a cross-sectional area that is constant along the axial direction, or a cross-sectional area that is inclined to be narrower.

As an operating effect of the third discharge guide groove 1443*c* according to this embodiment is similar to those of the previous embodiment, repetitive description thereof has been omitted. However, in this embodiment, as the third discharge guide groove 1443*c* has the wedge cross-sectional shape, it may be formed to correspond to an effective area of the refrigerant remaining space S. By reducing unnecessary area in the third discharge guide groove 1443*c*, an interference area with the vane 133 may be reduced, thereby preventing a front end of the vane 133 from being caught or stuck in the third discharge guide groove 1443*c*.

Referring to FIG. 15, the third discharge guide 1443 may be formed in the shape of a multi-layered cross-section along the circumferential direction. For example, the third discharge guide part 1443 may be formed such that a plurality of grooves are connected from one surface of the sixth discharge hole 1432 toward the contact point P. That is, the third discharge guide part 1443 may be configured as the plurality of circular grooves defined in an overlapping manner such that both surfaces in the radial direction are formed as a plurality of curves. Even in this case, the third discharge guide part 1443 may have a cross-sectional area that is constant along the axial direction, or a cross-sectional area that is inclined to be narrower.

As an operating effect of the third discharge guide part 1443 according to this embodiment is similar to that of the previous embodiment, repetitive description thereof has been omitted. However, in this embodiment, as the third discharge guide part 1443 is processed in the axial direction, the shape and depth of the third discharge guide 1443 may be variously formed in an easier manner.

Hereinafter, description will be given of another embodiment of a position (or location) of the discharge guide groove. That is, in the previous embodiments, the discharge guide groove is formed at the rear of the third discharge part, but in some cases, it may be formed at the rear of the first or second discharge part.

Figure 16A:
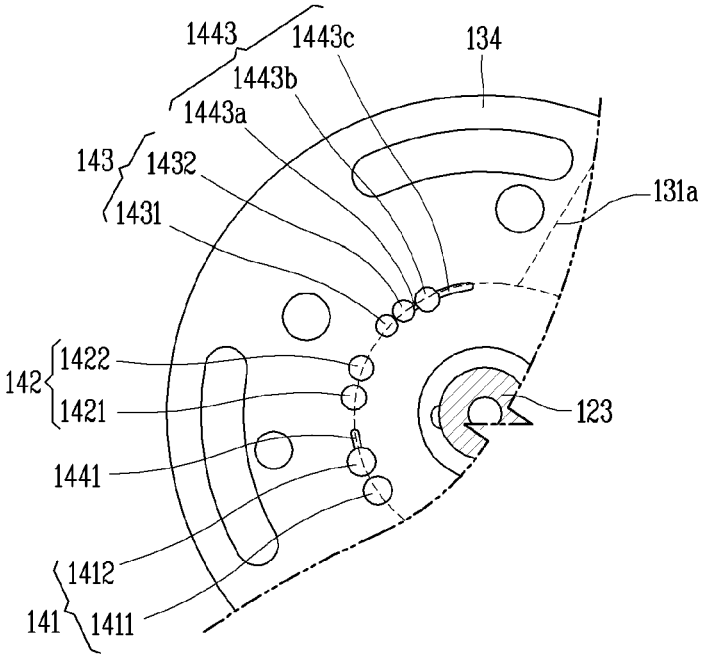
FIGS. 16A to 16C are planar views illustrating examples of a position of a discharge guide groove according to an embodiment.
Figure 16B:
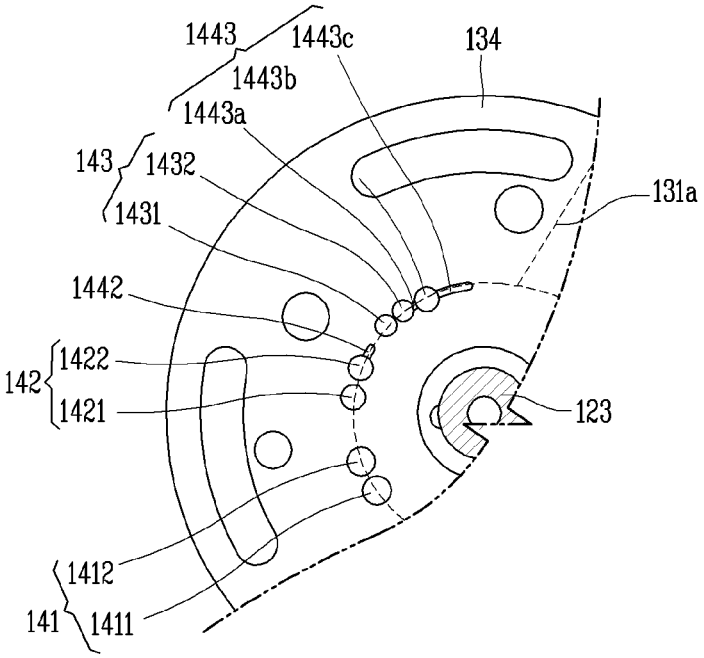
Figure 16C:
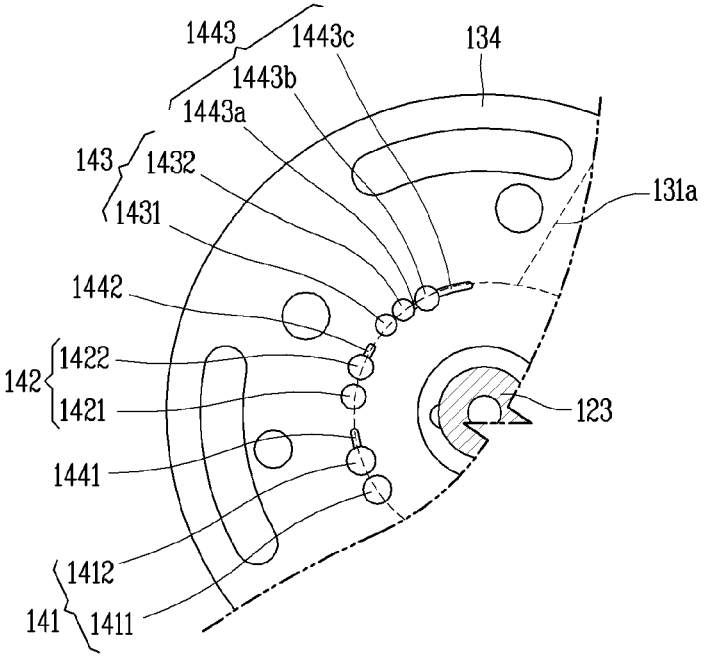

FIGS. 16A to 16C are planar views illustrating examples of a position of a discharge guide groove according to embodiments. Referring to FIG. 16A, the discharge guide part according to this embodiment may be formed at the rear of the first discharge part 141 in addition to the third discharge part 143.

The discharge guide part formed at the rear of the third discharge part 143 may be referred to as third discharge guide part 1443, and the discharge guide part formed at the rear of the first discharge part 141 may be referred to as first discharge guide part 1441. As the third discharge guide part 1443 is the same as those of the previous embodiments, repetitive description thereof has been omitted.

Of the discharge holes 1411 and 1412 that define the first discharge part 141, the first discharge guide part 1441 may extend toward the second discharge part 142 from the second discharge hole 1412 located rearward with respect to the rotational direction of the roller 132. For example, the first discharge guide part 1441 may be formed in an arcuate shape having one (first) end connected to the second discharge hole 1412 and another (second) end that extends to a position spaced apart from the third discharge hole 1421 located frontward of the second discharge part 142 with respect to the rotational direction of the roller 132 by a predetermined interval.

The first discharge guide part 1441 may have various shapes as in the previous embodiments. For example, the first discharge guide part 1441 may have a constant radial width or a radial width that gradually decreases toward the second discharge part 142. In addition, the first discharge guide part 1441 may have a cross-sectional area that is constant in the depthwise direction, or a cross-sectional area that is inclined to be narrower.

As such, when the first discharge guide part 1441 extends from the second discharge hole 1412 defining the first discharge part 141, an effective volume of the first discharge part 141 may be increased to thereby reduce the amount of refrigerant discharged. Accordingly, the amount of refrigerant discharged in the intermediate process of the discharge stroke may be increased, and thus, the amount of residual refrigerant that is not discharged even after passing through the last discharge part and remains in the refrigerant remaining space S may be reduced in advance.

Referring to FIG. 16B, the discharge guide part 144 according to this embodiment may be formed at the rear of the second discharge part 142 in addition to the third discharge part 143. In this case, the discharge guide part formed at the rear of the third discharge part 143 may be referred to as third discharge guide part 1443, and the discharge guide part formed at the rear of the second discharge part 142 may be referred to as second discharge guide part 1442. As the third discharge guide part 1443 is the same as those of the previous embodiments, repetitive description thereof has been omitted.

The second discharge guide part 1442 may extend toward the third discharge part 143 from the fourth discharge hole 1422 located rearward of the discharge holes 1421 and 1422 that define the second discharge part 142. For example, the second discharge guide part 1442 may be formed in an arcuate shape having one (first) end connected to the fourth discharge hole 1422 and another (second) end that extends to a position spaced apart from the fifth discharge hole 1431 located frontward of the third discharge part 143 by a predetermined interval.

The second discharge guide part 1442 may have various shapes as in the previous embodiments. For example, the second discharge guide part 1442 may have a constant radial width or a radial width that gradually decreases toward the third discharge part 143. In addition, the second discharge guide part 1442 may have a cross-sectional area that is constant in the depth direction, or a cross-sectional area that is inclined to be narrower.

As the second discharge guide part 1442 extends from the second discharge part 142, an effective volume of the second discharge part 142 may be increased, thereby increasing the amount of refrigerant discharged. Accordingly, the amount of refrigerant discharged in the intermediate process of the discharge stroke may be increased, and thus, the amount of residual refrigerant that is not be discharged even from the last discharge part and remains in the refrigerant remaining space S may be reduced in advance.

Referring to FIG. 16C, the discharge guide part 144 according to this embodiment may be provided at each of the rear of the first discharge part 141 and the second discharge part 142 in addition to the third discharge part 143. As this is a combination of the embodiment of FIG. 16A and the embodiment of FIG. 16B, repetitive description thereof has been omitted. When the first and second discharge guide parts 1441 and 1442 are further provided at the first discharge part 141 and the second discharge part 142, respectively, the effects of the embodiments of FIGS. 16A and 16B may be increased.

Hereinafter, description will be given of a discharge passage according to another embodiment. That is, in the previous embodiments, the plurality of discharge parts are independently formed at predetermined intervals along the circumferential direction. However, in some cases, a plurality of discharge parts may be connected to each other at one of an inlet and outlet of the discharge passage.

Figure 17:
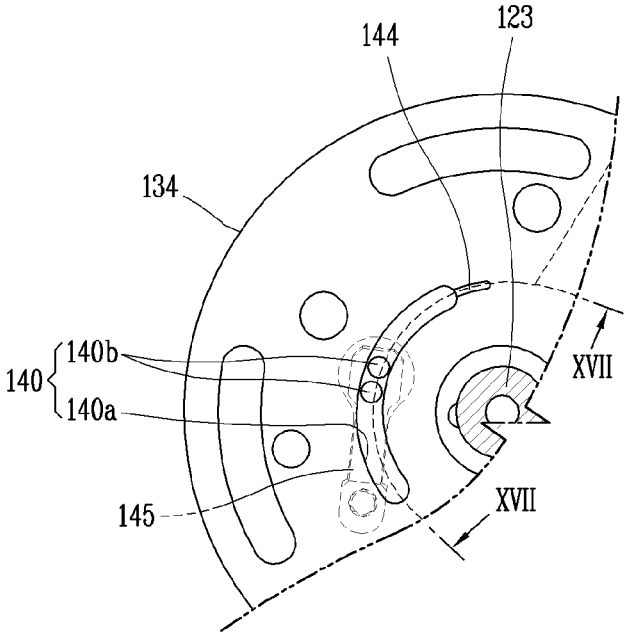
FIG. 17 is a planar view of a discharge passage according to another embodiment.
Figure 18:
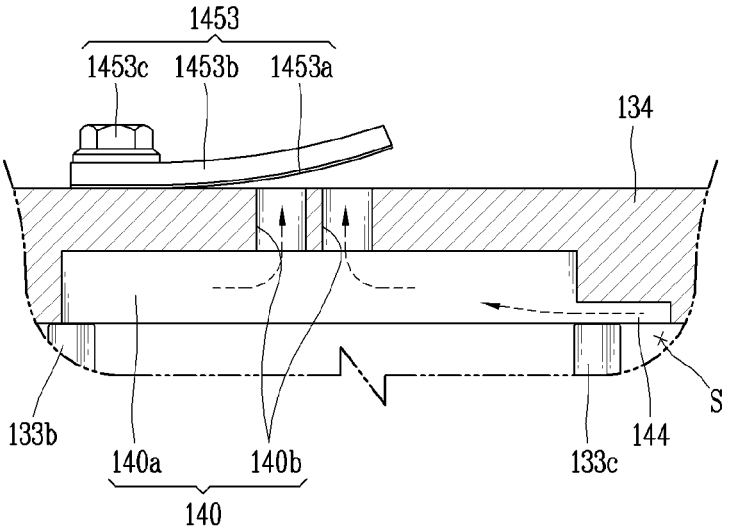
FIG. 18 is a cross-sectional view, taken along line "XVII-XVII" in FIG. 17.

FIG. 17 is a planar view of a discharge passage according to another embodiment, FIG. 18 is a cross-sectional view, taken along line "XVII-XVII" of FIG. 17.

As illustrated in FIGS. 17 and 18, discharge passage 140 according to this embodiment may include a discharge inlet 140*a* and a discharge outlet 140*b*. The discharge inlet 140*a* may be configured as a long (extended) groove that extends in the circumferential direction. For example, the discharge inlet 140*a* may be recessed from the lower surface 134*a* of the main bearing 134 by a predetermined depth and have an arcuate shape with a predetermined length along the circumferential direction, that is, the rotational direction of the roller.

A length of the discharge inlet 140*a* may be substantially the same as an arc length from the first discharge part 141 to the third discharge part 143 of the previous embodiment. Accordingly, the first discharge part 141, the second discharge part 142, and the third discharge part 143 may be connected to each other.

The discharge outlet 140*b* may be configured as at least one discharge hole that penetrates from the discharge inlet 140*a* to the upper surface 135*a* of the main bearing 134. This embodiment illustrates an example in which the discharge outlet 140*b* is configured as two discharge holes.

A cross-sectional area of the discharge outlet 140*b* may be smaller than a cross-sectional area of the discharge inlet 140*a*. Accordingly, only one valve member may be provided. For example, a valve member (valve) 145 including the discharge valve, the retainer, and the bolt described above may be provided at an upper surface of the main bearing 134, and one discharge valve and one retainer may be fixed to the main bearing 134 by one bolt.

When the discharge passage 140 includes the discharge inlet 140*a* configured as the long groove and the discharge outlet 140*b* configured as the discharge holes, an effective discharge volume for compressed refrigerant may be increased, thereby further reducing the amount of residual refrigerant in the refrigerant remaining space. In addition, even when the discharge passage 140 is formed long in the circumferential direction, the discharge passage 140 may be opened and closed by one valve member 145, and the number of valve members 145 may be reduced accordingly. As a result, manufacturing costs may be reduced.

In this embodiment, the discharge guide part 144 may be further provided at the discharge inlet 140*a*. As its operating effect is similar to those of the previous embodiments, repetitive description thereof has been omitted.

Hereinafter, description will be given of a discharge passage according to yet another embodiment. That is, in the previous embodiments, the discharge guide part is configured as the groove that extends from the discharge part, but in some cases, the discharge guide part may be configured as a hole.

Figure 19:
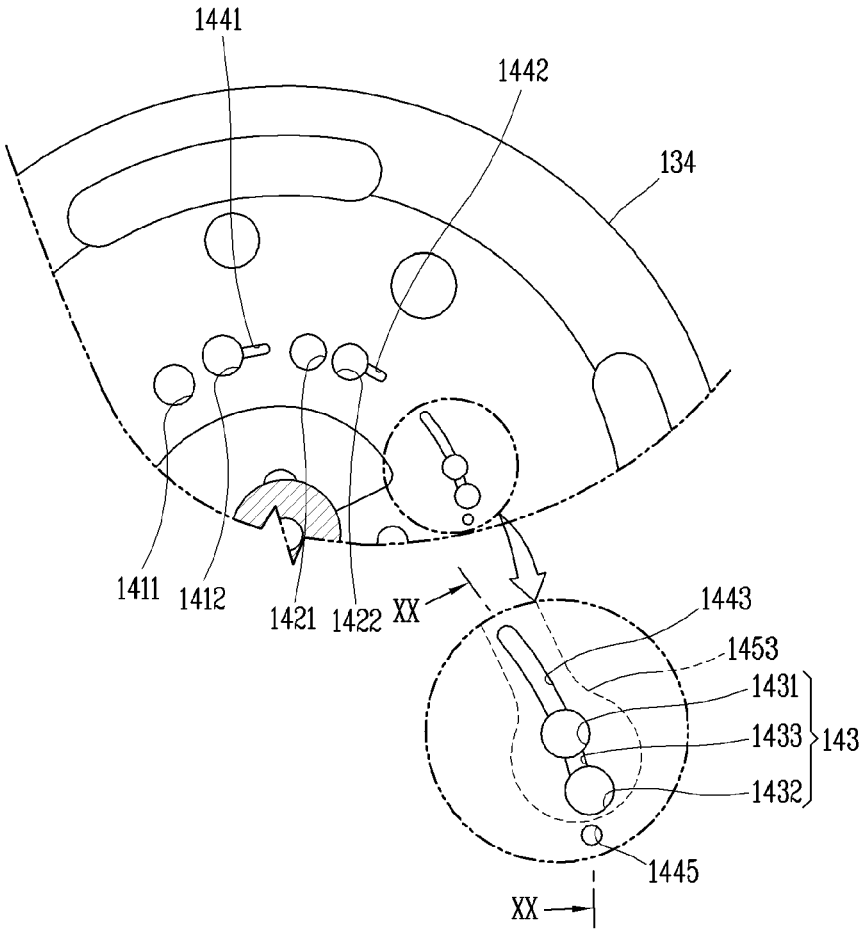
FIG. 19 is a planar view of a discharge passage according to yet another embodiment.
Figure 20:
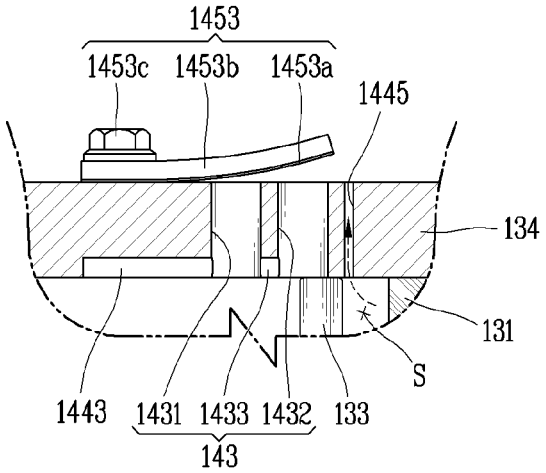
FIG. 20 is a cross-sectional view, taken along line "XX-XX" in FIG. 19.

FIG. 19 is a planar view of a discharge passage according to yet another embodiment. FIG. 20 is a cross-sectional view, taken along line "XX-XX" of FIG. 19.

Referring to FIGS. 19 and 20, the discharge passage 140 according to this embodiment may include a plurality of discharge parts (discharges) 141, 142 and 143, and a plurality of discharge guide parts (guides) 1441, 1442, and 1443. The plurality of discharge parts 141, 142, and 143 may be formed in the same manner as those of the previous embodiments. For example, the plurality of discharge parts may include first discharge part 141, second discharge part 142, and third discharge part 143. The first discharge part 141 may include first discharge hole 1411 and second discharge hole 1412, the second discharge part 142 may include third discharge hole 1421 and fourth discharge hole 1422, and the third discharge part 143 may include fifth discharge hole 1431 and sixth discharge hole 1432.

As the first discharge part 141, the second discharge part 142, and the third discharge part 143 are formed in the same manner as the discharge parts of the previous embodiments, repetitive description thereof has been omitted. However, in this embodiment, a communication groove 1433 that may provide communication between the fifth discharge hole 1431 and the sixth discharge hole 1432 that define the third discharge part 143.

A discharge guide part (guide) 144 may include a plurality of discharge guide parts (guides) 1441, 1442 and 1443, and a refrigerant discharge hole 1445. The discharge guide part 144 may extend from each of the discharge parts 141, 142, and 143 as described above. For example, the first discharge guide part 1441 may extend from the second discharge hole 1412 defining the first discharge part 141 in a direction toward contact point P, and the second discharge guide part 1442 may extend from the fourth discharge hole 1422 defining the second discharge part 142 in a direction toward the contact point P.

However, in this embodiment, the third discharge guide part 1443 may extend from the fifth discharge hole 1431 defining the third discharge part 143 in a direction opposite to those of the previous embodiments, namely, in a direction toward the second discharge part 142. Instead, the refrigerant discharge hole 1445 may be further defined in a refrigerant remaining space S of this embodiment.

The refrigerant discharge hole 1445 may penetrate between both surfaces of the main bearing 141 in the axial direction at the refrigerant remaining space S. For example, the refrigerant discharge hole 1445 may be formed between the sixth discharge hole 1432 defining the third discharge part 143 and the contact point P.

An inner diameter of the refrigerant discharge hole 1445 may be defined within a range of a cross-sectional area of the refrigerant remaining space S, namely, within a range that can be accommodated between the inner circumferential surface of the cylinder 131 and the outer circumferential surface of the roller 132. For example, the inner diameter of the refrigerant discharge hole 1445 may be smaller than an inner diameter of the sixth discharge hole 1432.

In addition, the refrigerant discharge hole 1445 may be open toward the inner space 110*a* of the case 110, more precisely, an inner space 136*a* of a discharge cover 136. For example, the refrigerant discharge hole 1445 may be located out of an opening and closing range of third valve member (valve) 1453. Accordingly, the refrigerant remaining space S may communicate with the inner space 136*a* of the discharge cover 136 at all times.

When the refrigerant discharge hole 1445 communicates with the refrigerant remaining space S, refrigerant remaining in the refrigerant remaining space S may be quickly discharged to the inner space 110*a* of the case 110, that is, the inner space of the discharge cover.

That is, in the previous embodiments, refrigerant remaining in the refrigerant remaining space S flows to the third discharge part 143 through the refrigerant guide part 144, and is then discharged to the inner space 110*a* of the case 110 through the sixth discharge hole 1432. However, the sixth discharge hole 1432 is opened and closed by the third valve member 1453, and thus, when pressure of a compression chamber including the sixth discharge hole 1432 is lower than a predetermined pressure, refrigerant that has moved to the sixth hole 1432 is not discharged and remains in the corresponding compression chamber.

However, in this embodiment, as the refrigerant discharge hole 1445 is defined in the refrigerant remaining space S and is always open without being opened or closed by the third valve member 1453, refrigerant flowing into the refrigerant remaining space S may be discharged when pressure the refrigerant is higher than pressure of the inner space 110*a* (the inner space of the discharge cover) of the case 110. Accordingly, the amount of refrigerant remaining in the refrigerant remaining space S may be minimized, thereby increasing compressor efficiency.

In addition, in this embodiment, as the discharge parts 141, 142, and 143 are provided with the discharge guide parts 1441, 1442, and 1443, respectively, some of refrigerant may be effectively discharged in the intermediate process of compression as described in the previous embodiments. Accordingly, the amount of refrigerant flowing into the refrigerant remaining space S may be reduced. As a result, compressor efficiency may be further increased.

Figure 21:
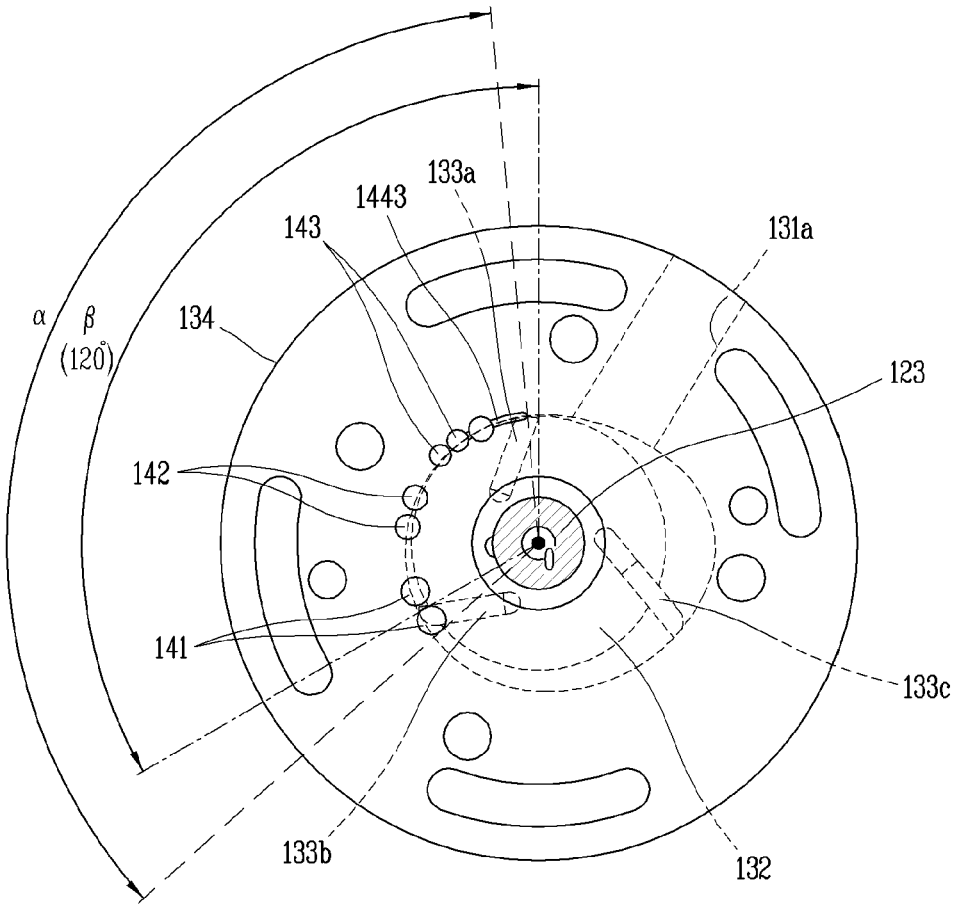
FIG. 21 is a planar view illustrating a relationship between a discharge passage and a vane according to an embodiment.

FIG. 21 is a planar view illustrating a relationship between a discharge passage and a vane. That is, FIG. 21 is a view for comparing an arc angle α between both (two) ends of the discharge passage 140 in the circumferential direction with an angle β between vanes adjacent to each other.

In the rotary compressor 100 according to embodiments disclosed herein, three vanes 133 are provided, but the number of vanes may vary according to a compressor. For the sake of convenience, the embodiments disclosed herein describe a case in which three vanes 133 are provided.

Referring to FIG. 21, three vanes 133*a*, 133*b*, and 133*c* according to this embodiment may be disposed at equal intervals along a circumferential direction of the roller 132. Accordingly, angle β between vanes which is defined as an arc angle between two adjacent vanes 133*a* and 133*b*, 133*b* and 133*c*, and 133*c* and 133*a* is 120° (degrees), respectively.

On the other hand, arc angle α of the discharge passage which is defined as an arc angle between both ends of the discharge passage 140 is greater than or equal to the angle β between the vanes, that is, arc angle α of the discharge passage 140 including the discharge guide part 144 [the third discharge guide part 1443 is illustrated in this embodiment] may be greater than the angle β between the vanes.

For example, the arc angle α of the discharge passage 140 corresponding to an arc length from an end of the inlet side of the first discharge hole 1411 to an end of the contact point side of the third discharge guide part 1443 that define both (two) ends of the discharge passage 140 may be greater than or equal to approximately 120° (degrees), or greater than 120°. Accordingly, the discharge passage 140 may extend to or out of a circumferential direction range of a corresponding compression chamber. Then, the discharge stroke for refrigerant in the compression chamber may be longer than the compression stroke. As a result, the amount of compressed refrigerant remaining in the compression chamber after the discharge stroke or remaining in the refrigerant remaining space S adjacent to the contact point may be minimized. Further, as the arc length of the discharge passage 140 is greater than or equal to arc lengths of the compression chambers V1, V2, and V3, continuous discharge may be enabled, thereby reducing pressure pulsation.

When the discharge passage 140 extends to or out of the circumferential direction range of the corresponding compression chamber, continuous discharge may be allowed during the discharge stroke to thereby suppress residual refrigerant and reduce pressure pulsation. Therefore, refrigerant leakage between compression chambers, and abrasion of the vane or the cylinder, described above, may be suppressed. Further, as the number and size of the discharge valves are maintained, an increase in manufacturing costs and a decrease in compression efficiency may be suppressed.

In the embodiments, the discharge passage 140 is defined in the main bearing 134, however, the discharge passage 140 may alternatively be defined in the sub bearing 135. As the basic configuration and operating effect of the discharge passage 140 are the same as those of the previous embodiments, description thereof will be replaced with the descriptions of the previous embodiments.

Although not shown in the drawings, a discharge hole may be defined in the sub bearing. In this case, a discharge passage may be formed in the sub bearing. Alternatively, a discharge hole may be defined in each of the main bearing and the sub bearing. Even in this case, a discharge passage may be formed in at least one of the main bearing or the sub bearing. When the discharge passage is defined in each of the bearings, refrigerant remaining in the refrigerant remaining space may be discharged more quickly.

Embodiments disclosed herein provide a rotary compressor that can reduce an amount of refrigerant remaining in a compression space without being discharged during a discharge stroke. Embodiments disclosed herein also provide a rotary compressor that can prolong or extend a substantial discharge stroke.

Embodiments disclosed herein further provide a rotary compressor that can increase an amount of refrigerant discharged by increasing an effective discharge area of the refrigerant. Embodiments disclosed herein further provide a rotary compressor that can reduce vibration noise of the compressor while suppressing wear of a vane or a cylinder.

Additionally, embodiments disclosed herein provide a rotary compressor that can resolve a difference between pressure acting on a front surface of a vane and back pressure acting on a rear surface of the vane. Embodiments disclosed herein also provide a rotary compressor that can allow pressure acting on a front surface of a vane to be uniform.

Embodiments disclosed herein provide a rotary compressor that can continuously discharge refrigerant during a discharge stroke to suppress refrigerant remaining in a compression chamber even after the discharging stroke and suppress pressure pulsation due to intermittent discharging. Embodiments disclosed herein provide a rotary compressor that can ensure continuous discharge of refrigerant by making a length of a discharge passage greater than or equal to a length of a compression chamber.

Embodiments disclosed herein provide a rotary compressor that can maintain a number and size of discharge valves and increase a length of a discharge passage. Additionally, embodiments disclosed herein provide a rotary compressor that can suppress shaking of a vane when high-pressure refrigerant, such as R32, R410a, and CO2, is used.

Embodiments disclosed herein provide a rotary compressor that may include a case, a cylinder, a roller, a vane, a main bearing and a sub bearing, and a discharge passage through which refrigerant compressed in a compression space may be discharged. The cylinder may be provided in the case to form a compression space. The roller may be rotatably provided in the cylinder and eccentric with respect to a center of the compression space to have a contact point closest to an inner circumferential surface of the cylinder.

The vane may be slidably inserted into a vane groove defined in the roller to divide the compression space into a suction space and a discharge space while rotating together with the roller. The main bearing and the sub bearing may be disposed above and below the cylinder, respectively, so as to form the compression space together with the cylinder.

The discharge passage may be defined in at least one of the main bearing or the sub bearing. The discharge passage may include a discharge hole and a discharge guide groove. The discharge hole may be formed through one of the main bearing or the sub bearing.

The discharge guide groove may have one (first) end that communicates with the discharge hole and another (second) end that extends from the discharge hole toward the contact point, and recessed from one surface of the one bearing provided with the discharge hole. With this configuration, a structure of the cylinder may be simplified, thereby facilitating processing. Also, a surface pressure between the vane in a periphery of the discharge hole and the cylinder may be reduced while being kept constant, and shaking or vibration of the vane may be reduced, thereby suppressing abrasion and vibration noise between the vane and the cylinder. In addition, refrigerant remaining between the discharge hole and the contact point may be moved toward the discharge hole through the discharge guide groove to be discharged. By suppressing refrigerant remaining in the compression space after a discharge stroke, compressor efficiency may be increased, shaking of the vane may be suppressed, and wear of the vane or the cylinder facing the vane may be suppressed.

Embodiments disclosed herein may include at least one or more of the following advantages. For example, a plurality of the discharge hole may be provided spaced apart from one another in a circumferential direction by predetermined intervals. The discharge guide groove may be defined between a discharge hole located closest to the contact point and the contact point. The another end of the discharge guide groove may be spaced apart from the contact point by a predetermined distance in the circumferential direction. Accordingly, refrigerant remaining between the contact point and the discharge hole located closest to the contact point may be effectively discharged while preventing the discharge guide groove from communicating with a suction port.

The discharge guide groove may extend in the shape of an arc along a circumferential direction. As the discharge guide groove is formed along the compression space, an area of the discharge guide groove belonging to the compression space may be increased, allowing refrigerant remaining in the compression space to be effectively discharged.

The discharge guide groove may extend linearly along a circumferential direction. Accordingly, the discharge guide groove may be easily processed.

The discharge guide groove may have at least a portion extending in a circumferential direction and an extended length of the portion may be greater than a radial width thereof. The discharge guide groove may include a first discharge guide groove, a second discharge guide groove, and a third discharge guide groove. The first discharge guide groove may have one (first) end communicates with the discharge hole and another (second) end that extends toward the contact point. The second discharge guide groove may communicate with the another end of the first discharge guide groove and be spaced apart from the discharge hole in a circumferential direction. The third discharge guide groove may have one (first) end that communicates with the second discharge guide groove and another (second) end that extends toward the contact point. The third discharge guide groove may have a long (extended) groove shape which is longer in the circumferential direction than the second discharge guide groove. As the discharge guide groove is located as much as possible within a range of the compression space, residual refrigerant may be more effectively discharged.

The third discharge guide groove may have a cross-sectional area that is larger than a cross-sectional area of the second discharge guide groove. Accordingly, the third discharge guide groove may be formed as close to the contact point as possible.

The third discharge guide groove may have a constant radial width. This may facilitate processing of the third discharge guide groove.

The third discharge guide groove may have a radial width that gradually decreases along a rotational direction of the roller. As the width of the third discharge guide groove is reduced, it is possible to prevent the vane from being caught in the third discharge guide groove.

The third discharge guide groove may have a cross-sectional area that is constant along a direction of a depth thereof. Accordingly, the third discharge guide groove may have a large volume.

The third discharge guide groove may have a cross-sectional area that decreases along a direction of a depth thereof. This may facilitate processing of the third discharge guide groove.

The discharge guide groove may be left and right (laterally) symmetric with respect to an extension line that extends from a center of the discharge hole along a circumferential direction of the main bearing or the sub bearing. This may facilitate processing of the discharge guide groove.

The discharge guide groove may be configured as a plurality of grooves connected to each other along a circumferential direction such that both surfaces in a radial direction are formed as a plurality of curves. As the discharge guide groove is processed in an axial direction, a shape and depth of the discharge guide groove may be variously formed in an easier manner.

The discharge hole may be configured as a plurality of discharge holes disposed at predetermined intervals along a circumferential direction. The plurality of the discharge holes may be formed such that a cross-sectional area of a discharge hole located rearward with respect to a rotational direction of the roller is smaller than a cross-sectional area of a discharge hole located frontward with respect to the rotational direction of the roller. As the discharge hole is located as much as possible within a range of the compression space, refrigerant may be effectively discharged.

The discharge hole may include a plurality of discharge parts (discharges) each having a pair of discharge holes with a same cross-sectional area. The plurality of discharge parts may be disposed at predetermined intervals along the circumferential direction. The discharge guide groove may communicate with a discharge part located at a rearmost end with respect to the rotational direction of the roller. As refrigerant remaining in a vicinity of the discharge part located at the rearmost end flows to the discharge part through the discharge guide groove to be discharged, refrigerant remaining in the compression space after the discharge stroke may be suppressed.

The discharge hole may include a discharge inlet having a long (extended) hole shape that extends in a circumferential direction and a discharge outlet having a cross-sectional area that is smaller than a cross-sectional area of the discharge inlet and that communicates with the discharge inlet. Accordingly, a volume of the discharge inlet may be increased, thereby increasing an amount of refrigerant discharged. Further, manufacturing costs may be reduced by decreasing the number of valve members that open and close the discharge outlet.

The discharge guide groove may extend from one side of the discharge inlet in a communicating manner and have a cross-sectional area that is smaller than the cross-sectional area of the discharge inlet. Accordingly, refrigerant remaining in a refrigerant remaining space between the contact point and the discharge hole may be effectively discharged.

A refrigerant discharge hole that is formed through the main bearing or the sub bearing may be defined between the contact point and the discharge hole located adjacent to the contact point. The refrigerant discharge hole may be opened and closed by a valve member (valve). The refrigerant discharge hole may be formed out of an opening and closing range of the valve member. As refrigerant remaining in the refrigerant remaining space between the contact point and the discharge hole is directly discharged through the refrigerant discharge hole, the refrigerant in the refrigerant remaining space may be discharged more quickly.

The refrigerant discharge hole may have a cross-sectional area that is smaller than a cross-sectional area of the discharge hole. This may suppress refrigerant from flowing back into the compression space through the refrigerant discharge hole.

A plurality of the vane may be provided spaced apart from one another by predetermined intervals along a circumferential direction of the roller. An arc angle between both ends in a circumferential direction of the discharge passage may be greater than or equal to an arc angle between vanes adjacent to each other in the circumferential direction. Accordingly, an effective area through which compressed refrigerant may be discharged may be maximized, allowing refrigerant remaining in the refrigerant remaining space to be effectively discharged. In addition, as continuous discharge is allowed during the discharge stroke, residual refrigerant may be suppressed and pressure pulsation may be reduced. Further, as the number and size of discharge valves are maintained, an increase in manufacturing costs and a decrease in compression efficiency may be suppressed.

At least one of the main bearing or the sub bearing may be provided with a discharge hole, and the discharge passage may be defined in the one bearing provided with the discharge hole. Accordingly, refrigerant remaining in the refrigerant remaining space may be quickly discharged.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A rotary compressor, comprising:

a case;

a cylinder provided in the case to form a compression space;

a roller rotatably provided in the cylinder and eccentric with respect to a center of the compression space to have a contact point to an inner circumferential surface of the cylinder;

at least one vane slidably inserted into a vane groove defined in the roller to divide the compression space into a suction space and a discharge space while rotating together with the roller;

a main bearing and a sub bearing disposed above and below the cylinder, respectively, so as to form the compression space together with the cylinder; and a discharge passage defined in at least one of the main bearing or the sub bearing to discharge refrigerant compressed in the compression space, wherein the discharge passage comprises:

at least one discharge hole formed through at least one of the main bearing or the sub bearing; and at least one discharge guide groove having a first end that communicates with the at least one discharge hole and a second end that extends from the at least one discharge hole toward the contact point, and recessed from a surface of the one of the main bearing or the sub bearing provided with the at least one discharge hole.

2. The rotatory compressor of claim 1, wherein the at least one discharge hole comprises a plurality of discharge holes spaced apart from one another in a circumferential direction by predetermined intervals, wherein the at least one discharge guide groove is defined between a discharge hole of the plurality of discharge holes located closest to the contact point, and wherein a second end of the at least one discharge guide groove is spaced apart from the contact point by a predetermined distance in the circumferential direction.

3. The rotatory compressor of claim 1, wherein at least a portion of the at least one discharge guide groove extends arcuately or linearly in a circumferential direction, and wherein a length of the portion of the at least one discharge guide groove extending in the circumferential direction is greater than a radial width of the at least one discharge guide groove.

4. The rotatory compressor of claim 1, wherein the at least one discharge guide groove comprises:

a first discharge guide groove having a first end that communicates with the at least one discharge hole and a second end that extends toward the contact point;

a second discharge guide groove that communicates with the second end of the first discharge guide groove and is spaced apart from the at least one discharge hole in the circumferential direction; and a third discharge guide groove having a first end that communicates with the second discharge guide groove and a second end that extends toward the contact point, and wherein the third discharge guide groove has an extended groove shape which is longer in the circumferential direction than the second discharge guide groove.

5. The rotatory compressor of claim 4, wherein the third discharge guide groove has a cross-sectional area which is larger than a cross-sectional area of the second discharge guide groove.

6. The rotatory compressor of claim 4, wherein the third discharge guide groove has a constant radial width.

7. The rotatory compressor of claim 4, wherein the third discharge guide groove has a radial width that gradually decreases along a rotational direction of the roller.

8. The rotatory compressor of claim 4, wherein the third discharge guide groove has a cross-sectional area which is constant along a direction of a depth thereof.

9. The rotatory compressor of claim 4, wherein the third discharge guide groove has a cross-sectional area that decreases along a direction of a depth thereof.

10. The rotatory compressor of claim 1, wherein the at least one discharge guide groove is laterally symmetric with respect to an extension line that extends from a center of the at least one discharge hole along a circumferential direction of the main bearing or the sub bearing.

11. The rotatory compressor of claim 1, wherein the at least one discharge guide groove comprises a plurality of grooves connected to each other along a circumferential direction such that both surfaces of the at least one discharge guide groove in a radial direction are formed as a plurality of curves.

12. The rotatory compressor of claim 1, wherein the at least one discharge hole comprises a plurality of discharge holes disposed at predetermined intervals along a circumferential direction, and wherein the plurality of the discharge holes is formed such that a cross-sectional area of a discharge hole located rearward with respect to a rotational direction of the roller is smaller than a cross-sectional area of a discharge hole located frontward with respect to the rotational direction of the roller.

13. The rotatory compressor of claim 12, wherein the at least one discharge hole includes a plurality of discharges each including a pair of discharge holes with a same cross-sectional area, wherein the plurality of discharges is disposed at predetermined intervals along the circumferential direction, and wherein the at least one discharge guide groove communicates with a discharge of the plurality of discharges located at a rearmost end with respect to the rotational direction of the roller.

14. The rotatory compressor of claim 1, wherein the at least one discharge hole comprises:

a discharge inlet having an extended hole shape that extends in a circumferential direction; and a discharge outlet having a cross-sectional area which is smaller than a cross-sectional area of the discharge inlet and that communicates with the discharge inlet, wherein the at least one discharge guide groove extends from a first side of the discharge inlet in a communicating manner and has a cross-sectional area which is smaller than the cross-sectional area of the discharge inlet.

15. The rotatory compressor of claim 1, wherein a refrigerant discharge hole that is formed through the main bearing or the sub bearing is defined between the contact point and the at least one discharge hole located adjacent to the contact point, wherein the refrigerant discharge hole is opened and closed by a valve, wherein the refrigerant discharge hole is formed outside of an opening and closing range of the valve, and wherein the refrigerant discharge hole has a cross-sectional area which is smaller than a cross-sectional area of the at least one discharge hole.

16. The rotatory compressor of claim 1, wherein the at least one vane comprises a plurality of vanes spaced apart from one another by predetermined intervals along a circumferential direction of the roller, and wherein an arc angle between both ends in a circumferential direction of the discharge passage is greater than or equal to an arc angle between vanes adjacent to each other in the circumferential direction.

17. A rotary compressor, comprising:

a case;

a cylinder provided in the case to form a compression space;

a roller rotatably provided in the cylinder and eccentric with respect to a center of the compression space to have a contact point to an inner circumferential surface of the cylinder;

at least one vane slidably inserted into a vane groove defined in the roller to divide the compression space into a suction space and a discharge space while rotating together with the roller;

a main bearing and a sub bearing disposed above and below the cylinder, respectively, so as to form the compression space together with the cylinder; and a discharge passage defined in at least one of the main bearing or the sub bearing to discharge refrigerant compressed in the compression space, wherein the discharge passage comprises:

a plurality of discharge holes formed through at least one of the main bearing or the sub bearing and spaced apart from one another in a circumferential direction; and at least one discharge guide groove having a first end that communicates with a discharge hole closest to the contact point of the plurality of discharge holes, and a second end that extends from the discharge hole toward the contact point, and recessed from a surface of the one of the main bearing or the sub bearing provided with the at least one discharge hole, wherein at least a portion of the at least one discharge guide groove extends arcuately or linearly in a circumferential direction, and wherein a length of the portion of the at least one discharge guide groove extending in the circumferential direction is greater than a radial width of the at least one discharge guide groove.

18. The rotatory compressor of claim 17, wherein the at least one discharge guide groove comprises:

a first discharge guide groove having a first end that communicates with the discharge hole and a second end that extends toward the contact point;

a second discharge guide groove that communicates with the second end of the first discharge guide groove and is spaced apart from the discharge hole in the circumferential direction; and a third discharge guide groove having a first end that communicates with the second discharge guide groove and a second end that extends toward the contact point, and wherein the third discharge guide groove has an extended groove shape which is longer in the circumferential direction than the second discharge guide groove.

19. A rotary compressor, comprising:

a case;

a cylinder provided in the case to form a compression space;

a roller rotatably provided in the cylinder and eccentric with respect to a center of the compression space to have a contact point to an inner circumferential surface of the cylinder;

at least one vane slidably inserted into a vane groove defined in the roller to divide the compression space into a suction space and a discharge space while rotating together with the roller;

a main bearing and a sub bearing disposed above and below the cylinder, respectively, so as to form the compression space together with the cylinder; and a discharge passage defined in at least one of the main bearing or the sub bearing to discharge refrigerant compressed in the compression space, wherein the discharge passage comprises:

a plurality of discharge holes formed through at least one of the main bearing or the sub bearing and spaced apart from one another in a circumferential direction; and at least one discharge guide groove having a first end that communicates with a discharge hole closest to the contact point of the plurality of discharge holes, and recessed from a surface of the one of the main bearing of the sub bearing provided with the at least one discharge hole, wherein plurality of discharge holes is formed such that a cross-sectional area of a discharge hole located rearward with respect to a rotational direction of the roller is smaller than a cross-sectional area of a discharge hole located frontward with respect to the rotational direction of the roller.

20. The rotatory compressor of claim 19, wherein the plurality of discharge holes each includes a pair of discharge holes with a same cross-sectional area, wherein the pairs of discharge holes are disposed at predetermined intervals along the circumferential direction, and wherein the at least one discharge guide groove communicates with a discharge hole of the plurality of discharge holes located at a rearmost end with respect to the rotational direction of the roller.

* * * * *